US010568174B1

(12) United States Patent
Stoneham

(10) Patent No.: US 10,568,174 B1
(45) Date of Patent: Feb. 18, 2020

(54) APPARATUS AND METHODS FOR CONTROLLING LED LIGHT FLUX

(71) Applicant: Edward B. Stoneham, Los Altos, CA (US)

(72) Inventor: Edward B. Stoneham, Los Altos, CA (US)

(73) Assignee: XTREMELUX CORPORATION, Campbell, CA (US)

( * ) Notice: Subject to any disclaimer, the term of this patent is extended or adjusted under 35 U.S.C. 154(b) by 0 days.

(21) Appl. No.: 16/337,412

(22) PCT Filed: Oct. 2, 2017

(86) PCT No.: PCT/US2017/054686
§ 371 (c)(1),
(2) Date: Mar. 28, 2019

(87) PCT Pub. No.: WO2018/064655
PCT Pub. Date: Apr. 5, 2018

Related U.S. Application Data

(60) Provisional application No. 62/402,514, filed on Sep. 30, 2016.

(51) Int. Cl.
*H05B 33/08* (2006.01)

(52) U.S. Cl.
CPC ..... *H05B 33/0845* (2013.01); *H05B 33/0815* (2013.01)

(58) Field of Classification Search
CPC ..... H05B 33/0845; H05B 33/0815
USPC ..... 315/294
See application file for complete search history.

(56) References Cited

U.S. PATENT DOCUMENTS 7,994,730 B2 * 8/2011 Tan ..... H05B 33/0818 315/246

* cited by examiner

*Primary Examiner* — Daniel D Chang

(57) ABSTRACT

A rectangular pulse generator system is operatively configured to generate a generator output signal, the generator output signal formed as a base rectangular waveform gated by a modulating rectangular waveform, the base rectangular waveform having a first frequency and the modulating rectangular waveform having a second frequency less than the first frequency. A low-pass filter coupled to the rectangular pulse generator system is configured to receive a filter input signal representative of the generator output signal and to produce a filter output signal representative of the filter input signal. A voltage-controlled current source coupled to the low-pass filter generates a drive signal conducted by at least one LED producing a light flux determined by the current level of the LED drive signal. Methods are devised for calibration and for setting the average light flux level.

25 Claims, 11 Drawing Sheets

APPARATUS AND METHODS FOR CONTROLLING LED LIGHT FLUX

RELATED APPLICATIONS

This application claims the benefit of U.S. Provisional Application No. 62/402,514, filed Sep. 30, 2016, which application is incorporated herein by reference in its entirety for all purposes.

BACKGROUND

Light flux refers to the total rate at which light is being emitted by a light source, and it may be expressed in terms such as radiant flux in units of light energy per unit of time, photon or quantum flux in units of numbers of photons per unit of time, or luminous flux in units of lumens per unit of time.

In the art of lighting using LEDs (light-emitting diodes) as light sources, various light flux setting systems exist, of which two basic types may be described as follows. One type is the analog dimming type, in which a controlling electrical level, such as a voltage, is used to adjust the current that a driver circuit puts through one or more LEDs. At a particular light flux setting the amount of current through the LEDs may be more or less steady (DC) and approximately proportional to the controlling electrical level. The light flux of the LEDs may be roughly proportional to the current through the LEDs and may thus be also roughly proportional to the controlling electrical level.

An analog dimming type of light flux setting system may take advantage of the fact that, over a certain useful current range, LEDs generate light more efficiently and last longer at lower currents than they do at higher currents. Systems that utilize highly efficient (~85% or greater) switching converters to regulate the current through the LEDs may operate with high energy efficiency (radiant flux per electrical input power consumed) at a maximum light flux level and with even higher energy efficiency at lower light flux levels down to, for example, twenty percent of the maximum light flux level. In addition, the LEDs in such systems may, at lower light flux levels, maintain their performance over operating periods many times longer than the lifetimes that they exhibit when operating at maximum flux levels. Analog dimming may, therefore, produce energy-saving and lifetime-extending advantages in LED lighting systems operated at light flux levels substantially lower than the maximum light flux levels of which the systems are capable. Typically, a switching converter acting as an LED current driver under analog control controls the current over a five-to-one or ten-to-one range and turns the current off completely below the minimum of that range.

Another type of light flux setting system is a pulse-width-modulation (PWM) type, sometimes also referred to as a pulse-code modulation (PCM) type. This type of system sets an average light flux by allowing a rectangular-waveform signal known as the PWM signal to turn the energy source on and off repeatedly at high speed with a duty cycle ranging between zero and one-hundred percent. With LEDs, the light emission may be turned alternately fully on and fully off through modulation of the current through the LEDs by the PWM signal.

As in analog dimming, a highly efficient switching converter may be utilized to regulate the current through the LEDs. Contrary to the analog dimming approach, however, the PWM light flux setting system operates the LEDs at their maximum flux level during the part of the cycle in which the LEDs are fully on and is not designed to reduce the current to non-zero levels below the current level required for the maximum flux level. As a result, a PWM light flux setting system in the existing art generally does not take advantage of increased efficiencies that can result from lower LED currents, and the perceived lifetimes of the LEDs are increased in inverse proportion to the duty cycle, but not as much as they would be if the light flux setting were accomplished with a reduction in current as in an analog dimming system. A PWM light flux setting system may have advantages in terms of precise linear control of the light flux, which light flux may be accurately proportional to the duty cycle of the PWM signal, and in terms of stability of the wavelength spectrum of the LED, since this spectrum may have some dependence on the instantaneous current through the LED, which current is held constant during the maximum-current part of the PWM cycle. In addition, a PWM system typically can control average light flux over a much wider range than can an analog dimming system. The light flux range is limited by the minimum pulse time over which maximum current can be achieved in the driver and by the maximum period between pulses that can be allowed under flicker limitations.

SUMMARY

An apparatus and methods for controlling LED light flux are described.

In an example, an LED light flux setting system comprises a rectangular pulse generator system, a low-pass filter, a voltage-controlled current source, and at least one LED.

The rectangular pulse generator system is operatively configured to generate a generator output signal, the generator output signal formed as a base rectangular waveform gated by a modulating rectangular waveform, the base rectangular waveform having a first frequency and the modulating rectangular waveform having a second frequency less than the first frequency.

The low-pass filter has a cutoff frequency and is coupled to the rectangular pulse generator system and configured to receive a filter input signal representative of the generator output signal and to produce a filter output signal representative of the filter input signal with frequencies above the cut-off frequency being attenuated compared to frequencies below the cutoff frequency.

The voltage-controlled current source is coupled to the low-pass filter and responsive to a control voltage signal representative of the filter output signal for generating an LED drive signal having a current level representative of a voltage level of the control voltage signal.

The at least one LED is configured to conduct the LED drive signal, the at least one LED producing a light flux determined by the current level of the LED drive signal.

In another example, an LED light flux setting system comprises a microprocessor, a low-pass filter, a voltage-controlled current source, and at least one LED.

The microprocessor is configured to generate a generator output signal, the generator output signal formed as a base rectangular waveform gated by a modulating rectangular waveform, the base rectangular waveform having a first frequency more than 10 kHz and the modulating rectangular waveform having a second frequency less than one-tenth of the first frequency, the microprocessor being controllable to vary a duty cycle of the base rectangular waveform and a frequency and duty cycle of the modulating rectangular waveform.

The low-pass filter has a cut-off frequency between the first frequency and the second frequency and is coupled to the rectangular pulse generator system and configured to receive a filter input signal representative of the generator output signal and produce a filter output signal representative of the filter input signal with frequencies above the cut-off frequency being attenuated compared to frequencies below the cutoff frequency. The low-pass filter includes a capacitor and a resistive voltage divider, the resistive voltage divider applying a portion of a voltage of the filter input signal to the capacitor.

The voltage-controlled current source and at least one LED are similar to those of the first example.

In an example, an LED light flux setting method is devised comprising generating, by a rectangular pulse generator system, a base rectangular waveform having a first frequency and a first duty cycle; gating the base rectangular waveform with a modulating rectangular waveform having a second frequency less than the first frequency and a second duty cycle, the gated base rectangular waveform forming a generator output signal; filtering a filter input signal representative of the generator output signal with a low-pass filter having a cutoff frequency to produce a filter output signal representative of the filter input signal with frequencies above the cut-off frequency being attenuated compared to frequencies below the cutoff frequency; generating an LED drive signal having a current level representative of a voltage level of a control voltage signal representative of the filter output signal; and producing a light flux determined by the current level of the LED drive signal by conducting the LED drive signal in at least one LED.

DETAILED DESCRIPTION OF VARIOUS EMBODIMENTS

The disclosed apparatus, architectures, algorithms, and methods for a system controlling LED light flux will become better understood through review of the following detailed description in conjunction with the drawings. The detailed description and drawings provide examples of the various embodiments described herein. Those skilled in the art will understand that the disclosed examples may be varied, modified, and altered without departing from the scope of the disclosed structures. Many variations are contemplated for different applications and design considerations; however, for the sake of brevity, not every contemplated variation is individually described in the following detailed description.

In LED light sources there usually are limits to how low the operating current of the LEDs can be taken before the efficiency decreases or the lifetime of the LEDs decreases substantially or the light fluxes from different LEDs driven by the same current begin to vary unacceptably from one LED to another.

Moreover, a switching converter may produce unacceptably inaccurate current levels when operated at low current levels. Accurate sensing of the LED current in an electrically noisy switching environment requires a current-sensing resistance high enough to drop a voltage well above the electrical noise level. Increasing the current-sensing resistance to maintain sufficient voltage drop at low LED currents results in increased power dissipation at higher LED currents. This higher power dissipation causes a reduction in the efficiency of the switching converter. A tradeoff must be made between the current range and the efficiency.

Typically, a switching converter acting as an LED current driver under analog control is limited to a current control range in the neighborhood of five-to-one or ten-to-one.

An embodiment of a compound-PWM (CPWM) hybrid light flux setting system is described in more detail with reference to FIGS. 1-20. In the various figures, like or similar features may have the same reference labels. Each figure may include one or more views of objects.

Figure 1:
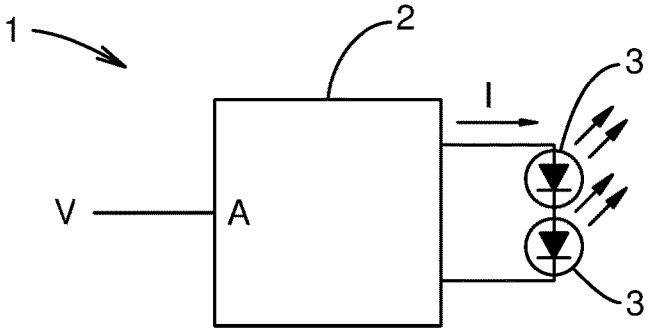
FIG. 1 is a schematic block diagram of an example of a voltage-controlled current source supplying current to one or more LEDs.

FIG. 1 shows a schematic block diagram of an example of an analog-controlled light source 1. A voltage-controlled current source 2 may supply an LED current I to an at least one LED 3. LED current I is dependent on a control voltage V present on an analog control input A of voltage-controlled current source 2.

Figure 2:
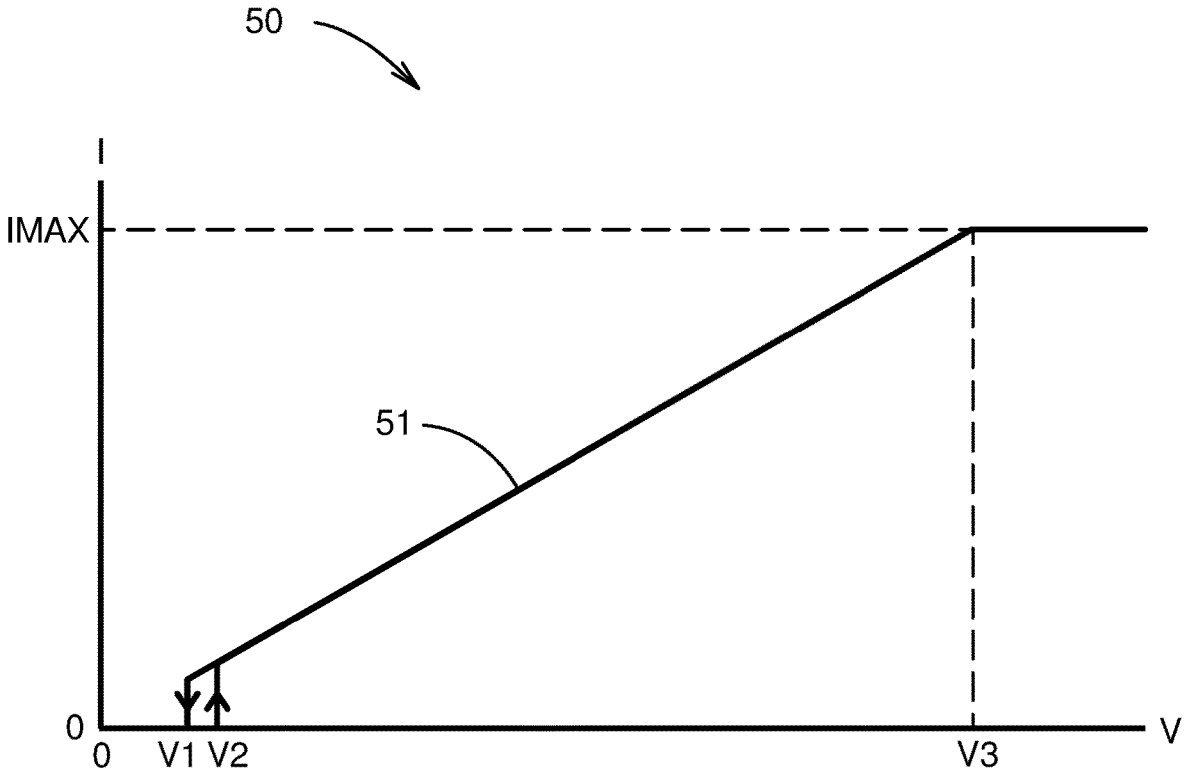
FIG. 2 is a graph of an example of a current-versus-voltage characteristic of the voltage-controlled current source included in FIG. 1.

The dependence of LED current I on control voltage V may be as shown by a current-versus-voltage graph 50 given by example in FIG. 2. At very low control voltage V, LED current I may be essentially zero. As control voltage V increases and reaches a value V2 the LED current I may jump to a level proportional to value V2, where the proportionality constant may be equal to the slope of a substantially linear portion 51 of the relationship between LED current I and control voltage V. At control voltage values between V2 and a saturation voltage V3 the LED current I may remain proportional to control voltage V until control voltage V reaches a saturation voltage V3 at and above which LED current I may become constant at a maximum current level IMAX. With descending control voltage V the LED current I may follow the same curve, except that the substantially linear portion 51 may continue for control voltage V levels between V2 and a level V1 at which LED current I may drop to substantially zero. The difference between V2 and V1, which is known in the art as hysteresis, may be intentionally created in order to maintain stability in the presence of electrical noise when control voltage V is in the vicinity of levels V2 and V1.

Figure 3:
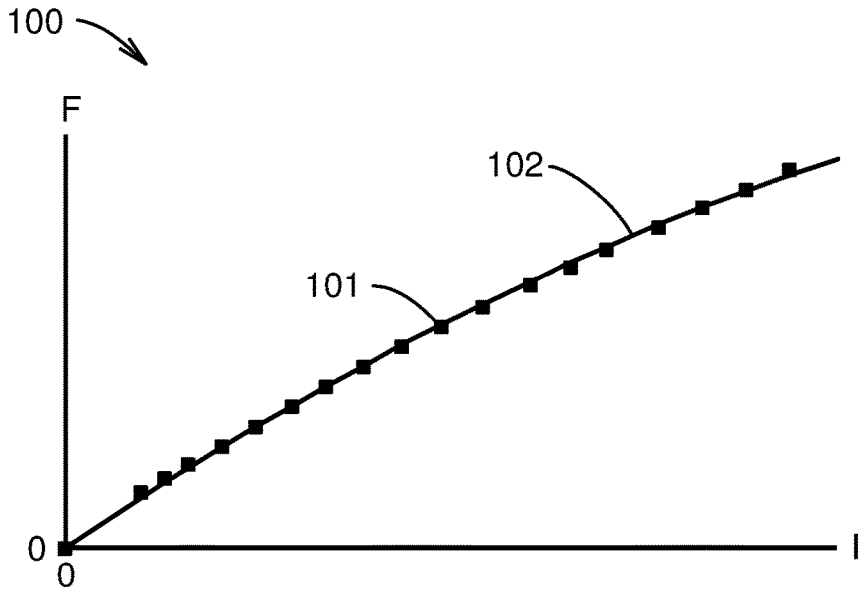
FIG. 3 graphs light flux values at various currents for a typical LED over its operating range and includes a quadratic curve fit to the data points.

A typical dependence of a light flux F emitted by the one or more LEDs 3 on LED current I is plotted in a flux-versus-current graph 100 in FIG. 3. Some markers 101 show light flux F values at various levels of LED current I as taken from a data sheet for a commercially available LED. A fitted flux-versus-current curve 102 graphs a relationship of the form $F=A\cdot I^2+B\cdot I$ in which constants A and B have been adjusted to reduce to a small number the mean-square difference between the values given by flux-versus-current curve 102 and the values given by markers 101. It can be noted that flux-versus-current curve 102 may match markers 101 with an accuracy typically better than a few percent.

Figure 4:
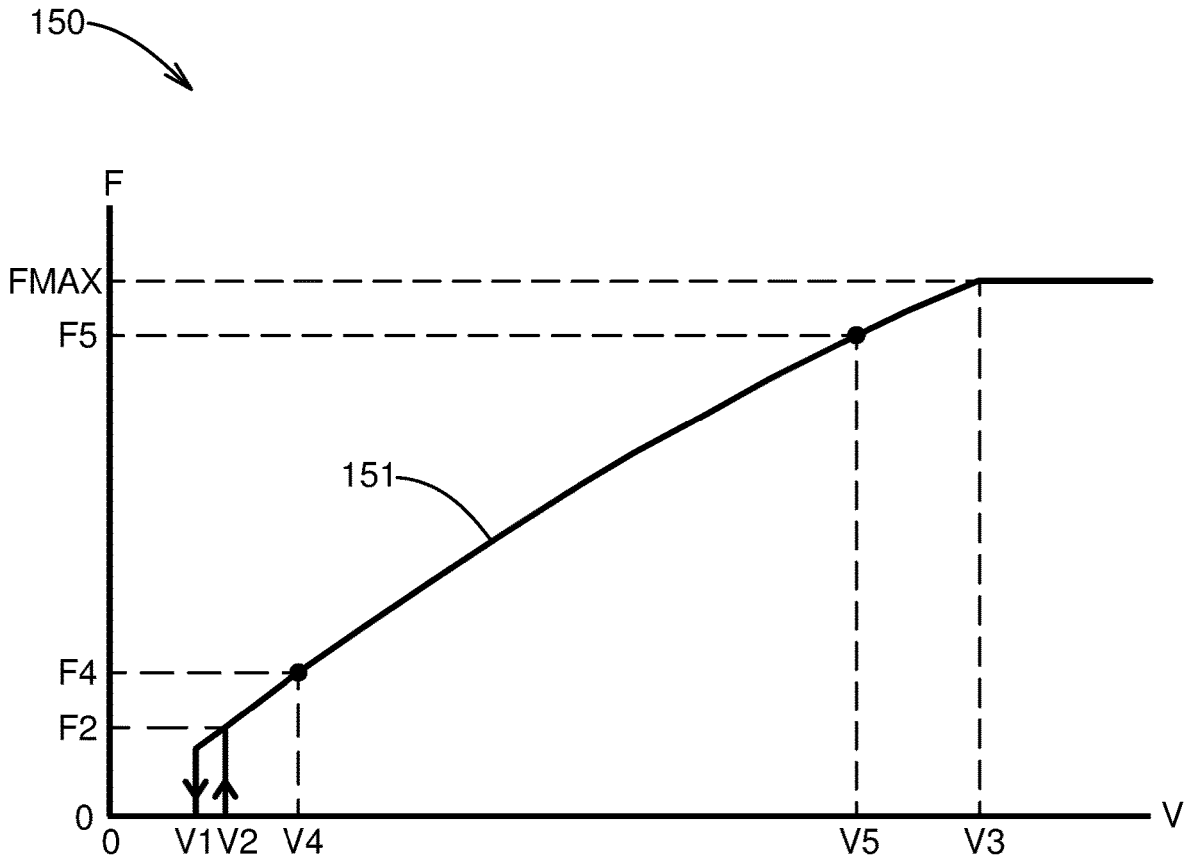
FIG. 4 plots the approximate light-flux-versus-control-voltage response of the circuit of FIG. 1 resulting from the typical characteristics in FIGS. 2 and 3.

Combining the LED current I dependence on control voltage V shown in FIG. 2 with the light flux F dependence on LED current I shown in FIG. 3 results in a light flux F dependence on control voltage V shown by a control graph 150 in FIG. 4. Due to the near-linearity of the substantially linear portion 51 of the current-versus-voltage graph 50 in FIG. 2, the nearly-quadratic relationship of light flux F versus LED current I shown in FIG. 3 is preserved as a quadratic portion 151 of the light flux F as a function of control voltage V curve shown in FIG. 4. The relationship between light flux F and control voltage V over the quadratic portion 151 may be closely approximated, therefore, as $F=C\cdot V^2+D\cdot V$, where F quantifies the light flux F, V quantifies the control voltage V, and C and D are constants independent of V.

Useful values of the constants C and D may be determined from measurements of light flux F at two different control voltage points, a voltage V4 and a voltage V5, suitably chosen between voltages V1 and V3 as shown in graph 150 of FIG. 4. Voltage V4 may be set close to voltage V2 to produce a light flux F4 moderately close to the minimum controllable level at control voltage level V1 but reliably achievable, and voltage V5 may be chosen to produce a light flux F5 moderately close to but less than a maximum light flux level FMAX. The constants C and D may, for example, then be calculated uniquely as $C=(F4/V4-F5/V5)/(V4-V5)$ and $D=(F5\cdot V4/V5-F4\cdot V5/V4)/(V4-V5)$. With these values of C and D, then, the light flux F at any control voltage V between control voltage V2 and control voltage V3 may be closely approximated by $F=C\cdot V^2+D\cdot V$. Using the inverse of this relationship, the control voltage V required to achieve a light flux F between a light flux level F2, associated with control voltage V2, and light flux level FMAX may be closely approximated by $V=((1+4\cdot C\cdot F/D^2)^{0.5}-1)\cdot D/(2\cdot C)$. Hence, the determination of the control voltage settings V4 and V5 at two light flux levels F4 and F5 respectively may result in a calibration from which the control voltage V required to produce approximately a desired light flux F within a reachable range may be easily calculated.

The method just described for determining the control voltage V required to achieve a given reachable light flux F through the use of a quadratic curve-fit approximation is simple and uses analytical solutions. It will be clear to persons skilled in the art, however, that lower-order and higher-order algebraic or polynomial curve fit equations may be used instead, or that transcendental equations, piecewise equations, or table look-ups may be used to approximate measured data taken at fewer or more points on the measured light-flux-versus-control-voltage curve. Also, it will be clear that numerical, iterative, and/or table look-up methods may be used, where analytical solutions are unavailable or undesirable, to optimize the parameters for a curve fit and to find approximate values of control voltage V to achieve desired light flux values F. In addition, it will be clear that curve-fitting functions giving control voltage V in terms of light flux F may be used instead of functions giving light flux F in terms of control voltage V, thereby avoiding the need to invert a function to determine a control voltage level V for a desired light flux value F.

Figure 5:
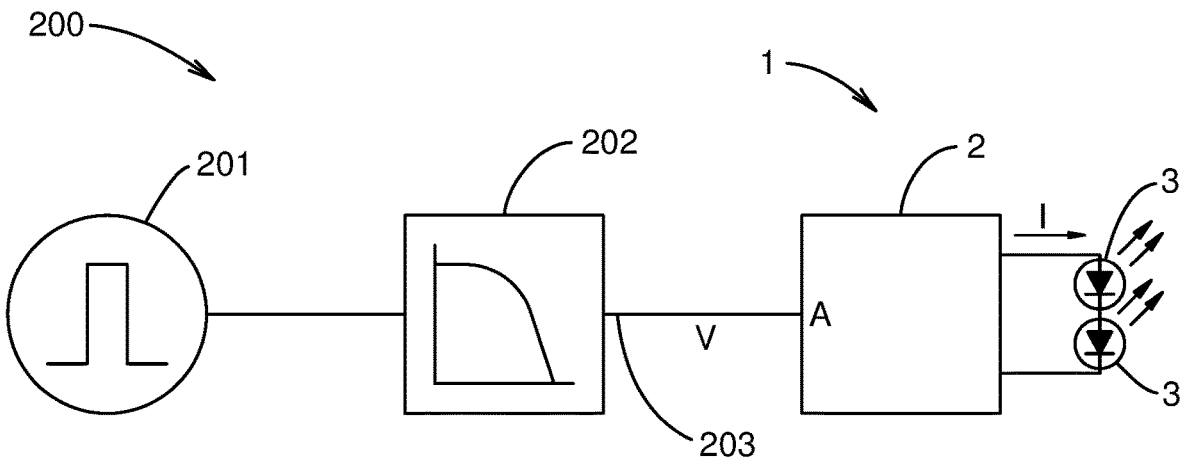
FIG. 5 is a schematic block diagram of an example of a hybrid light flux setting system in which a rectangular pulse generator coupled with a low-pass filter is used to create a control voltage.

FIG. 5 shows a block diagram of an example of a hybrid light flux setting system 200 in which a rectangular pulse generator 201 cascaded with a low-pass filter 202 is used to create the control voltage V at the analog control input A of voltage-controlled current source 2 in analog-controlled light source 1.

Rectangular pulse generator 201 may be a PWM generator capable of producing a signal with a desired frequency and a variable duty cycle.

Figure 6:
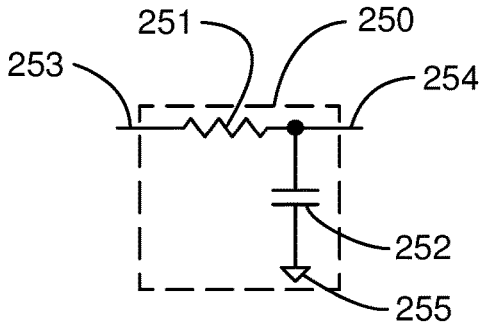
FIG. 6 shows the circuit diagram of an example of a simple R-C low-pass filter.

Low-pass filter 202 may be a simple R-C (resistor-capacitor) filter such as a simple R-C filter 250 shown in FIG. 6 having a series resistor 251, a parallel capacitor 252, a filter input node 253, a filter output node 254, and an electrical ground node 255. Series resistor 251 may be electrically connected at one of its two ends to filter input node 253 and at its other end to filter output node 254, and parallel capacitor 252 may be electrically connected at one of its two ends to filter output node 254 and at its other end to electrical ground node 255.

Figure 7:
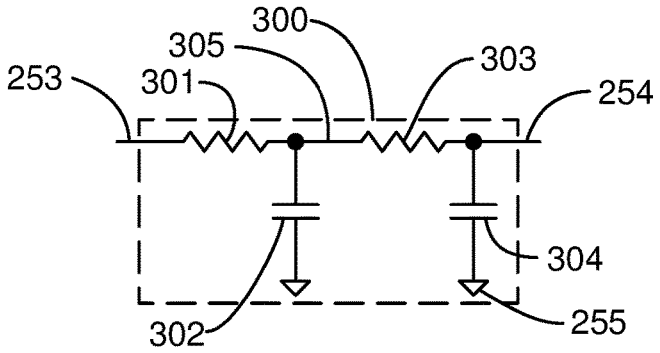
FIG. 7 shows the circuit diagram of an example of a two-stage R-C low-pass filter.

Alternatively, low-pass filter 202 may be an L-C (inductor-capacitor) filter (not shown), a multi-stage R-C filter such as a two-stage R-C filter 300 as shown in FIG. 7, or an active or passive filter of a less or more complex type as is well known in the art.

Two-stage R-C filter 300 may include a first resistor 301, a first capacitor 302, a second resistor 303, and a second capacitor 304. First resistor 301 may be electrically connected at one of its two ends to filter input node 253 and at its other end to an intermediate node 305, and second resistor 303 may be electrically connected at one of its two ends to intermediate node 305 and at its other end to filter output node 254. First capacitor 302 may be electrically connected at one of its two ends to intermediate node 305 and at its other end to electrical ground node 255, and second capacitor 304 may be electrically connected at one of its two ends to filter output node 254 and at its other end to electrical ground node 255.

The term "node" used in previous paragraphs and in the remainder of this description may be defined as a point in a circuit, to which point one or more terminals of circuit elements may be electrically connected and have substantially identical electrical potential or voltage.

Figure 8A:
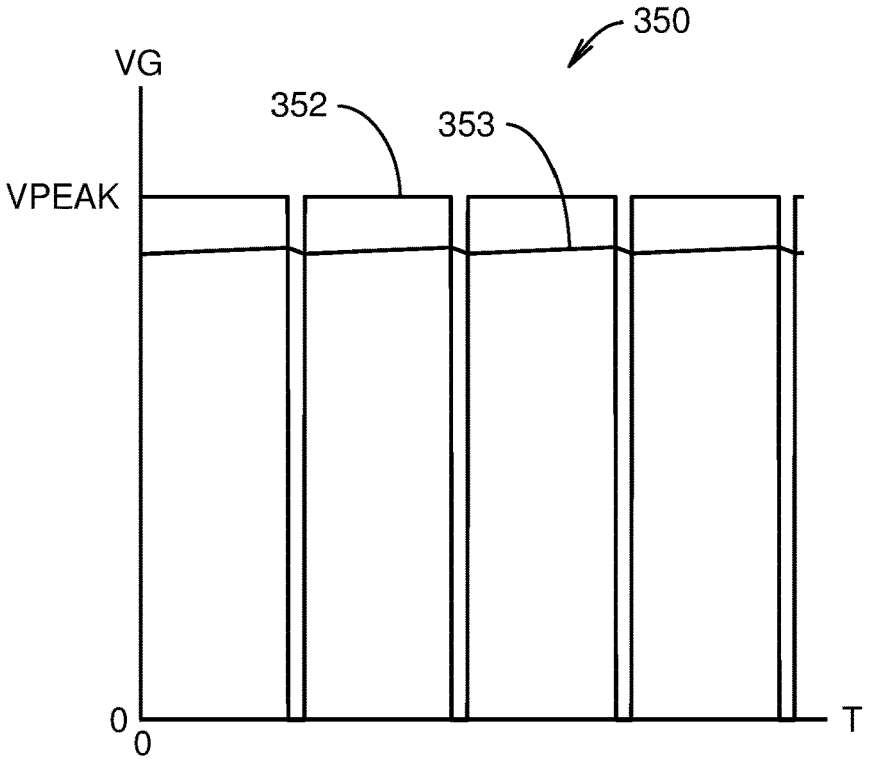
FIG. 8A shows an example of a graph of simulation results demonstrating the transformation of a PWM signal at the input of a low-pass filter into an approximately DC voltage at the output of the filter when the duty cycle of the PWM signal is 90%.
Figure 8B:
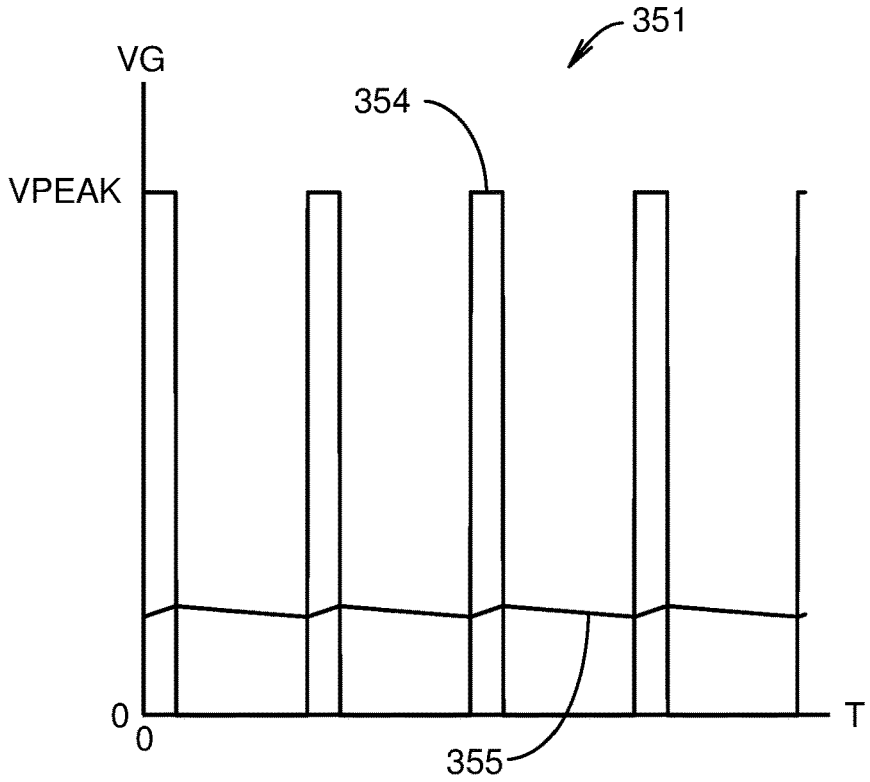
FIG. 8B shows an example of a graph of simulation results demonstrating the transformation of a PWM signal at the input of a low-pass filter into an approximately DC voltage at the output of the filter when the duty cycle of the PWM signal is 20%.

Shown in FIGS. 8A and 8B are a first graph 350 and a second graph 351 of a general voltage VG versus time T. In first graph 350 a first locus 352 plots a rectangular waveform with a duty cycle of 90% generated by rectangular pulse generator 201, and a second locus 353 plots an example of the resulting steady-state control voltage V at the analog control input A of voltage-controlled current source 2 in the hybrid light flux setting system 200 of FIG. 5. In this example, low-pass filter 202 may be the simple R-C filter 250, as shown in FIG. 6, with a particular R •C time constant equal to 7.48 times the period of the rectangular waveform with first locus 352. In this example it may be assumed that the output impedance of rectangular pulse generator 201 is negligibly small and that the input impedance at analog control input A is high enough to present a negligible load to filter output node 203 of low-pass filter 202. As depicted in FIG. 8A by second locus 353, the steady-state control voltage V resulting from the 90% duty cycle may be an approximately DC (direct current) voltage equal to approximately 90% of a peak voltage VPEAK of the rectangular waveform plotted by first locus 352.

In second graph 351 in FIG. 8B a third locus 354 plots a rectangular waveform with a duty cycle of 20% generated by rectangular pulse generator 201, and a fourth locus 355 plots the resulting steady-state control voltage V at the analog control input A of voltage-controlled current source 2. In this example, all conditions other than the duty cycle may be assumed to be unchanged from the conditions associated with first graph 350 in FIG. 8A. Fourth locus 355 demonstrates that the steady-state control voltage V resulting from the 20% duty cycle may be an approximately DC voltage equal to approximately 20% of the peak voltage VPEAK of the rectangular waveform plotted by third locus 354.

In general, for any duty cycle ranging from 0% to 100%, the average voltage of the approximately DC control voltage V in the hybrid light flux setting system 200 of FIG. 5 under the conditions described above may be substantially equal to the duty cycle times the peak voltage VPEAK of the rectangular waveform and may therefore be a somewhat predictable and approximately linear function of duty cycle. With a hybrid light flux setting system 200 as diagrammed in FIG. 5 the techniques described previously for calibration and for setting control voltage V to achieve a desired light flux may be applied equally well when PWM duty cycle is used in place of control voltage V as the controlling variable.

Figure 9:
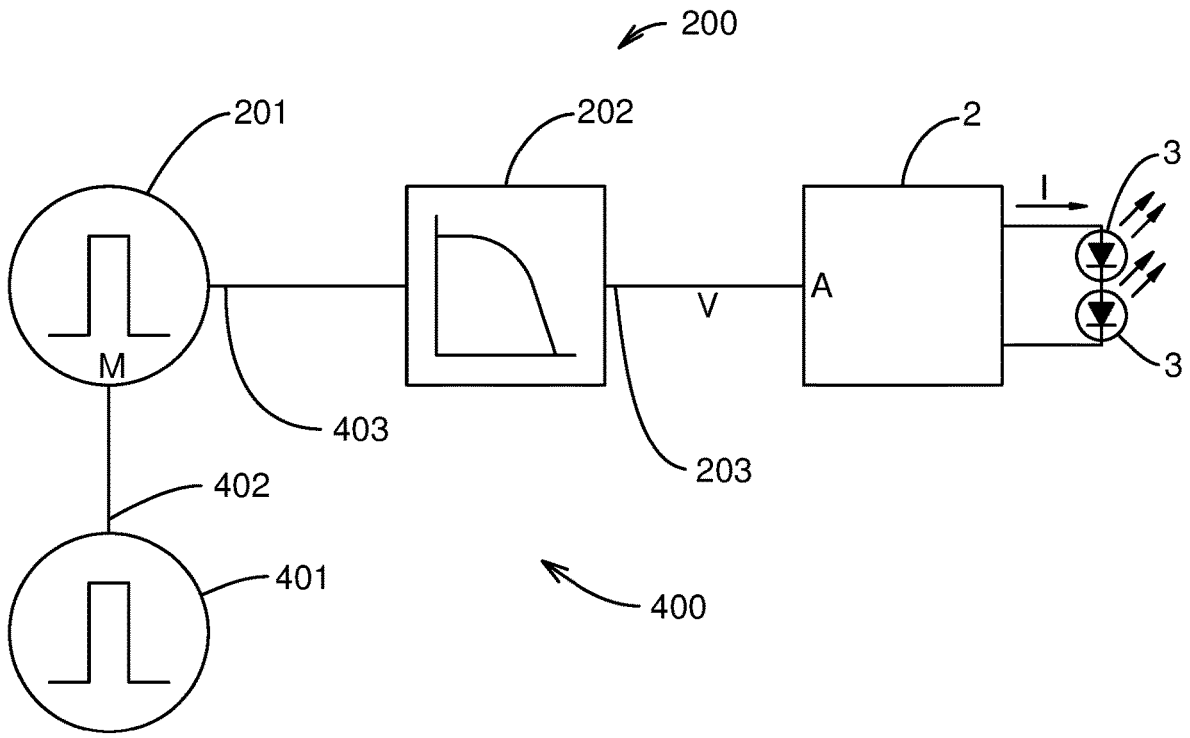
FIG. 9 is a schematic block diagram of an example of a first implementation of a CPWM (compound pulse-width modulation) hybrid light flux setting system.

FIG. 9 shows, as an example, a first implementation 400 of a CPWM hybrid light flux setting system, in which a second rectangular pulse generator 401 has been added to hybrid light flux setting system 200 of FIG. 5. A second output 402 of second rectangular pulse generator 401 is connected to a modulation input M on rectangular pulse generator 201. The modulation activated by modulation input M may be such that whenever the signal at second output 402 of second rectangular pulse generator 401 is substantially at its peak, the signal at a first output 403 of rectangular pulse generator 201 is substantially the same as was described previously with reference to FIGS. 5 and 8, and whenever the signal at second output 402 of second rectangular pulse generator 401 is substantially at its minimum, the voltage at the first output 403 of rectangular pulse generator 201 is substantially zero.

Figure 10:
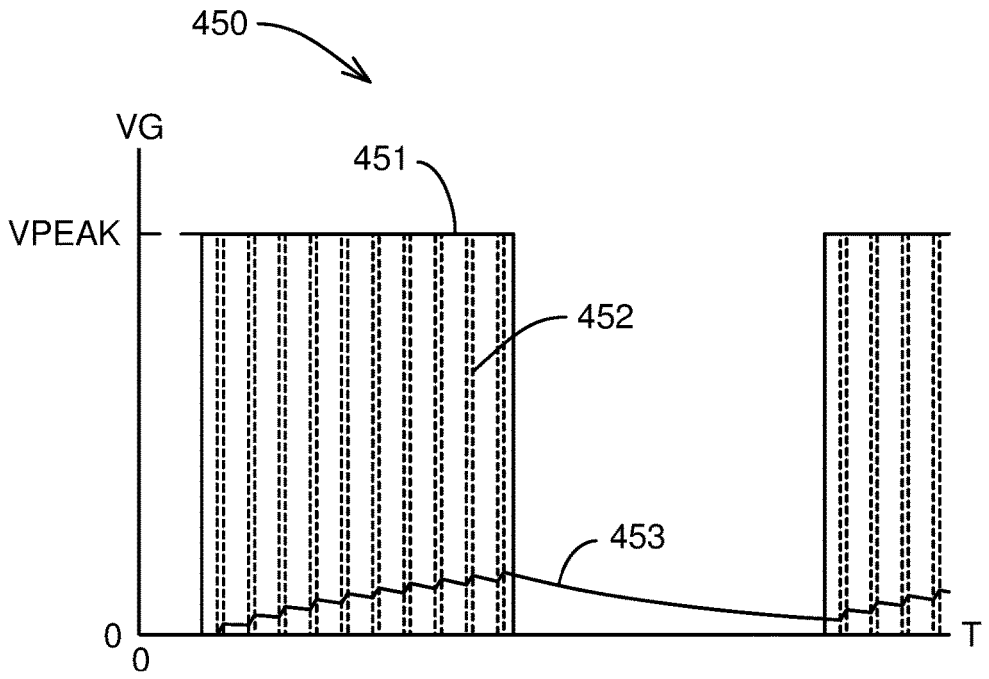
FIG. 10 graphs example waveforms of the signals within the CPWM generator and at the output of the low-pass filter in the system of FIG. 9.

A modulation result graph 450 in FIG. 10 plots three voltages over time in a particular case to demonstrate an example of the operation of first implementation 400. A modulation locus 451 plots the voltage versus time at second output 402 of second rectangular pulse generator 401. In the particular case shown, modulation locus 451 has a PWM duty cycle of 50%. A modulated locus 452 plots the voltage versus time at first output 403 of rectangular pulse generator 201. In the particular example shown, rectangular pulse generator 201 operates at a frequency equal to twenty times the frequency of modulation locus 451 and has a PWM duty cycle of 20%. A filtered result locus 453 plots the voltage versus time at filter output node 203 of low-pass filter 202. In the particular case shown as an example, low-pass filter 202 is assumed to be a simple R-C filter 250 as shown in FIG. 6 in which the R·C time constant is 7.48 times the period of rectangular pulse generator 201, which period is defined as the reciprocal of the frequency at which rectangular pulse generator 201 is operates.

It will be observed that, during times T when modulation locus 451 is at peak voltage VPEAK, filtered result locus 453 rises toward the steady state shown by fourth locus 355 in FIG. 8 and that, during the time periods when the voltage shown by modulation locus 451 is at zero, filtered result locus 453 falls toward zero.

Figure 11A:
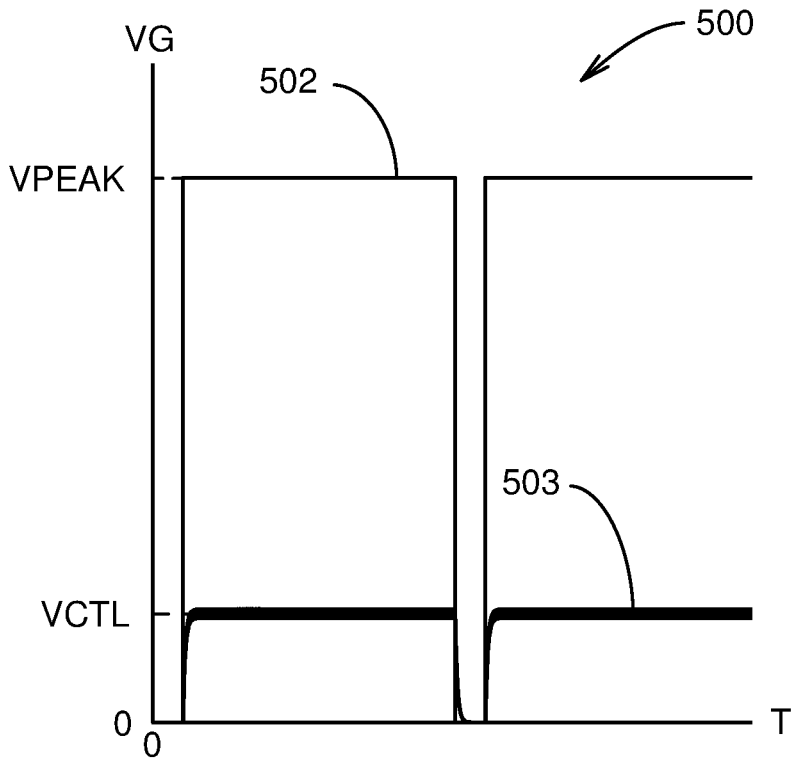
FIG. 11A graphs examples of the modulating waveform and simulated low-pass filter output voltage in the system of FIG. 9 for operation at a modulation duty cycle of 90%.
Figure 11B:
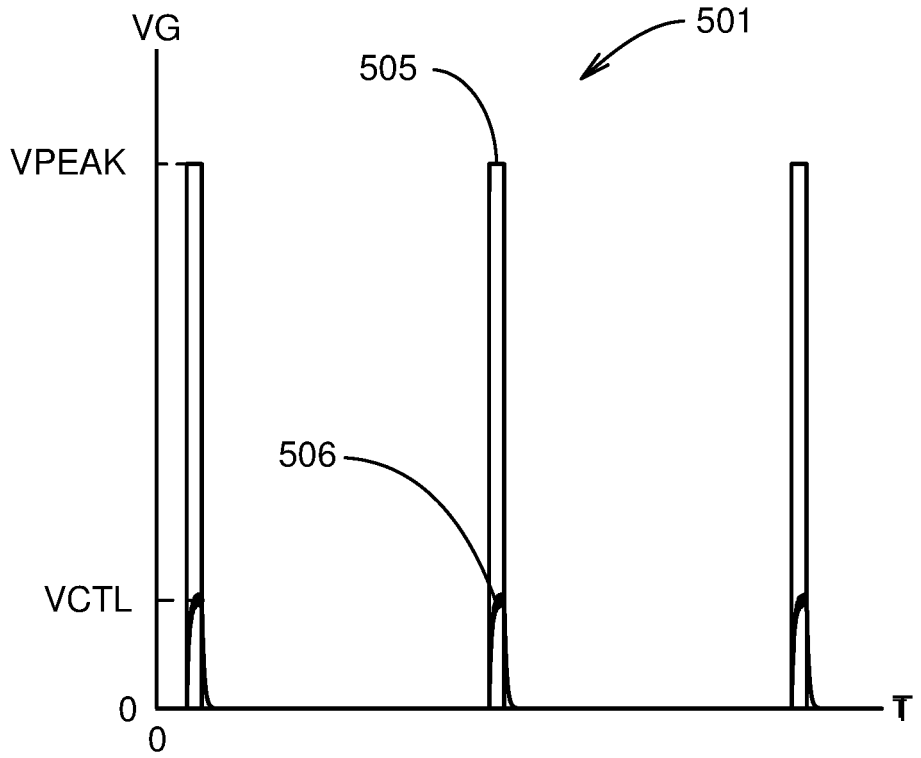
FIG. 11B graphs examples of the modulating waveform and simulated low-pass filter output voltage in the system of FIG. 9 for operation at a modulation duty cycle of 6%.

FIGS. 11A and 11B show, in a 90%-modulation-duty-cycle-graph 500 and a 6%-modulation-duty-cycle-graph 501 respectively, examples of the results that may be achieved when the frequency of second rectangular pulse generator 401 is set to one two-thousandth of the frequency setting of rectangular pulse generator 201 with no other changes, other than changes in duty cycle, relative to the situation graphed in FIG. 10.

In the 90%-modulation-duty-cycle-graph 500 in FIG. 11A, a 90% modulation locus 502 plots the voltage at second output 402 of second rectangular pulse generator 401 when the duty cycle of second rectangular pulse generator 401 is set to 90%. The resulting waveform at filter output node 203 is shown by a 90% result locus 503. The 90% result locus 503 represents approximately a rectangular waveform with a peak amplitude VCTL equal to 20% of peak voltage VPEAK and with a duty cycle of 90%. When presented to analog control input A of voltage-controlled current source 2 as shown in FIG. 9, this rectangular waveform may act to pulse-width modulate the 20%-of-maximum LED current I that voltage-controlled current source 2 drives through the one or more LEDs 3 when a steady voltage equal to peak amplitude VCTL is presented to analog control input A. The average light flux from the LEDs will thus be approximately 90% of the light flux emitted at a steady LED current I of 20% of the maximum current IMAX (see FIG. 2).

If the duty cycle of second rectangular pulse generator 401 is dropped to lower values, the average light flux from the LEDs will drop accordingly. In 6%-modulation-duty-cycle-graph 501 in FIG. 11B, a 6% modulation locus 505 plots the voltage at second output 402 of second rectangular pulse generator 401 when the duty cycle of second rectangular pulse generator 401 is 6%. The resulting waveform at filter output node 203 is shown by a 6% result locus 506. The 6% result locus 506 represents approximately a rectangular waveform with peak amplitude VCTL equal to 20% of peak voltage VPEAK and with a duty cycle of 6%. When presented to analog control input A of voltage-controlled current source 2 as shown in FIG. 9, this rectangular waveform may act to pulse-width modulate the 20%-of-maximum LED current I that voltage-controlled current source 2 drives through the one or more LEDs 3 when a steady voltage equal to peak amplitude VCTL is presented to analog control input A. The average light flux from the LEDs will thus be approximately 6% of the light flux emitted at a steady LED current I of 20% of the maximum current IMAX (see FIG. 2).

It will be clear to persons skilled in the art that the average light flux from the LEDs will be substantially proportional to the duty cycle of second rectangular pulse generator 401 so long as the resulting waveform at filter output node 203 closely approximates a rectangular waveform.

It will also be clear that the approximation to a rectangular waveform becomes poor when the width of the pulses at the second output 402 of second rectangular pulse generator 401 becomes too small. Deviations from rectangularity are starting to become significant in the 6% result locus 506 shown in 6%-modulation-duty-cycle-graph 501. Further reduction of the duty cycle, and hence the pulse width, of second rectangular pulse generator 401 may, in fact, result in pulses at filter output node 203 that fall significantly short of peak amplitude VCTL. To prevent this deviation from linearity, the narrowing of the pulse width of second rectangular pulse generator 401 as duty cycle is decreased should stop at a point short of the point at which unacceptable deviations from rectangularity in the waveform at filter output node 203 may occur. Further reductions in the duty cycle of second rectangular pulse generator 401 may then be achieved through reduction of the frequency of the pulses from second rectangular pulse generator 401.

Figure 12:
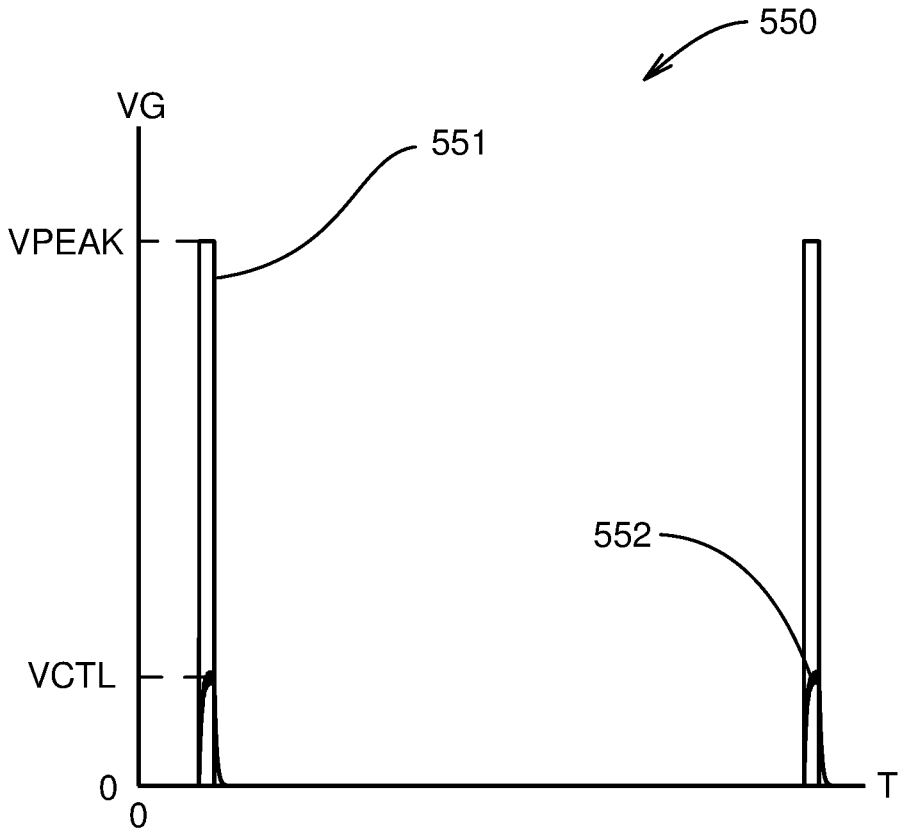
FIG. 12 graphs examples of the modulating waveform and simulated low-pass filter output voltage in the system of FIG. 9 for operation at a modulating frequency half that of the modulating frequency used in FIG. 11B and with the modulation duty cycle equal to half that used in FIG. 11B.

A graph 550 in FIG. 12 shows as an example a result that may occur when the frequency of second rectangular pulse generator 401 is reduced to half of the frequency featured in FIG. 11 B. A 3% modulation locus 551 plots the voltage at the output of second rectangular pulse generator 401, which now has a duty cycle of 3%. A 3% result locus 552 shows an example of a resulting waveform at filter output node 203 that, to the same degree as the waveform of FIG. 11B, approximates a rectangular waveform, but now with a 3% duty cycle. So long as the pulse width from second rectangular pulse generator 401 remains constant, the duty cycle can be set arbitrarily low through reduction of the frequency of second rectangular pulse generator 401. As will be clear to persons skilled in the art, the duty cycle will be an accurate linear function of the reciprocal of this frequency.

Figure 13:
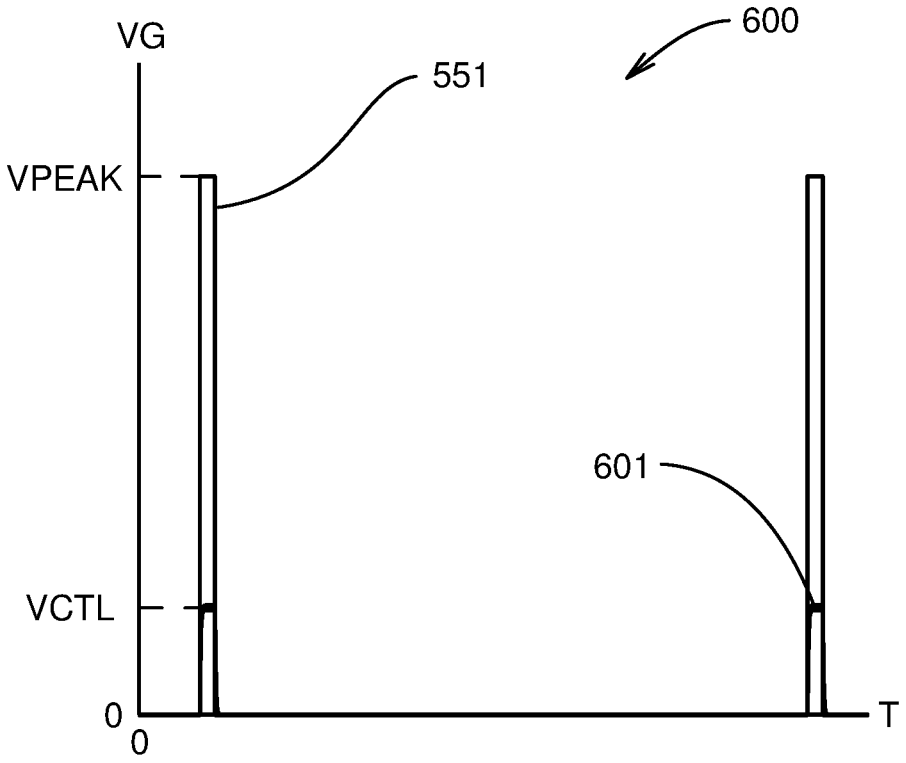
FIG. 13 graphs examples of the same data as in FIG. 12, except with a two-stage low-pass filter in place of the one-stage low-pass filter, resulting in a waveform at the filter output more accurately approximating a rectangular waveform.

The results demonstrated in FIGS. 11B and 12 may be improved through the use of filters of higher order than that of simple R-C filter 250 (FIG. 6). In FIG. 13 an improved result graph 600 shows an example of results from first implementation 400 (FIG. 9) with all parameters unchanged from those chosen for FIG. 12, except for the replacement of simple R-C filter 250 with two-stage R-C filter 300 (FIG. 7) to act as low-pass filter 202. The values of the components within two-stage R-C filter 300 in the example of improved result graph 600 are 5,500 ohms for first series resistor 301, 1275 pF for first shunt capacitor 302, 16,500 ohms for second series resistor 303, and 425 pF for second shunt capacitor 304. Comparing an improved 3% result locus 601 in FIG. 13 to the 3% result locus 552 in FIG. 12 may demonstrate how two-stage R-C filter 300 with the given component values may yield a 3% result locus that more closely approximates a rectangular waveform with 3% duty cycle. At some cost in complexity, therefore, the linearity of LED current as a function of the duty cycle of second rectangular pulse generator 401 may be made more accurate, or an existing degree of linearity may be preserved down to lower duty cycle limits.

It will be clear to persons skilled in the art that similar improvements may also be achieved with simple R-C filter 250 acting as low-pass filter 202 if, for example, the frequency setting of rectangular pulse generator 201 is increased and the R·C time constant of simple R-C filter 250 is decreased in proportion to the square root of the period of rectangular pulse generator 201. Practical limitations, however, including limitations on the speed and accuracy of rectangular pulse generator 201 and problems created by parasitic reactances in the circuitry, may limit the maximum frequency to which rectangular pulse generator 201 can be set without impairment of performance results.

The technique of modulating a PWM generator with another PWM generator to produce waveforms of the type exemplified by modulated locus 452 in FIG. 10, and the types underlying FIGS. 11A through 13, may be termed compound pulse-width modulation (CPWM). The combination of second rectangular pulse generator 401 and rectangular pulse generator 201 connected to each other as shown in FIG. 9, may be considered to be a rectangular pulse generator system capable of generating a CPWM signal at first output 403.

Figure 14:
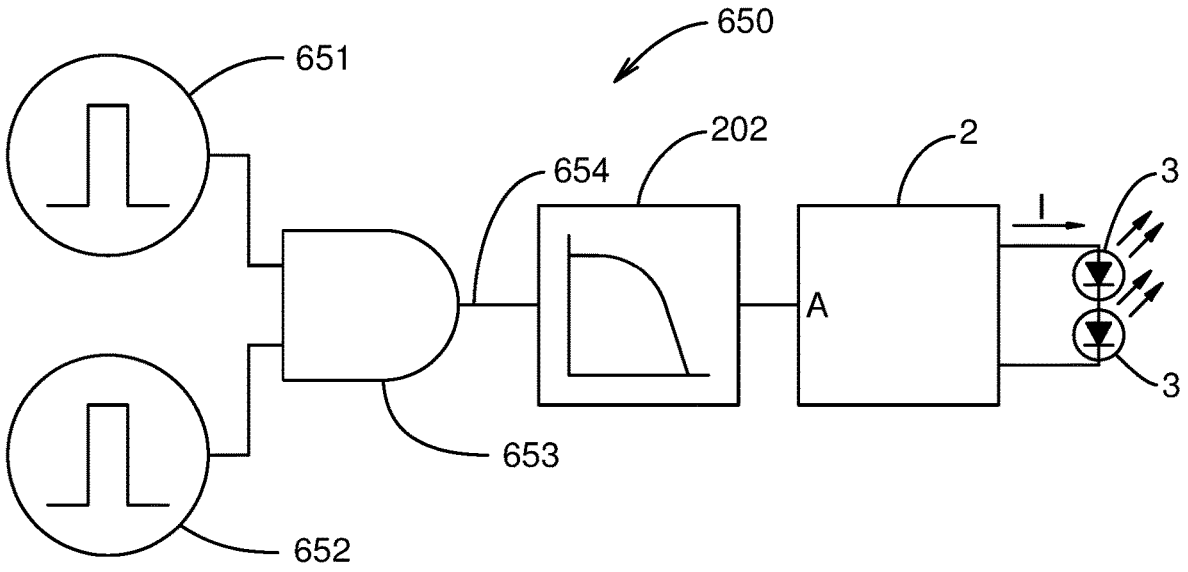
FIG. 14 is a schematic block diagram of an example of a second implementation of a CPWM hybrid light flux setting system featuring the use of two rectangular waveform generators feeding an AND gate to generate the CPWM signal.

There are many ways in which a CPWM generator capable of controlling a hybrid light flux setting system 200 (FIG. 5) may be architected. FIG. 14 shows a block diagram of a second implementation 650 of a CPWM hybrid light flux setting system. The CPWM generator in this implementation comprises a high-frequency PWM generator 651 and a low-frequency PWM generator 652 each connected to a separate input of an AND gate 653. As will be clear to persons skilled in the art, AND gate 653 as connected in second implementation 650 may act as a 100% amplitude modulator, and the waveform at AND gate output 654 may be of the type exemplified by modulated locus 452 in FIG. 10.

The combination of high-frequency PWM generator 651, low-frequency PWM generator 652, and AND gate 653 all connected to each other as shown in FIG. 14, may be considered to be a rectangular pulse generator system capable of generating a CPWM signal at its output 654.

Figure 15:
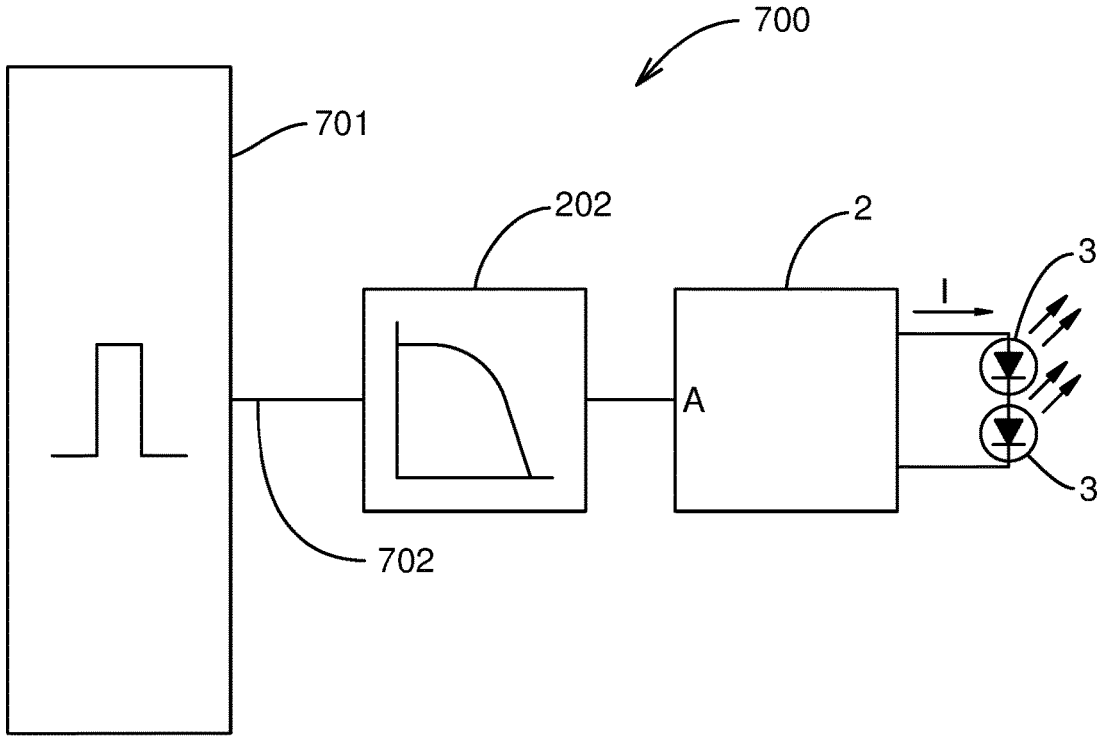
FIG. 15 is a schematic block diagram of an example of a third implementation of a CPWM hybrid light flux setting system featuring the use of a microprocessor with a PWM output to generate the CPWM signal.

FIG. 15 shows a block diagram of a third implementation 700 of a CPWM hybrid light flux setting system. A microprocessor 701 with a PWM output 702 may be programmed with internal timers to turn the signal at PWM output 702 on and off at substantially arbitrary times, thereby subjecting PWM output 702 to 100% amplitude modulation. Many commercially available microprocessors have a built-in capability for generating PWM signals without the use of CPU (central processing unit) resources. Such a microprocessor may be set to output a PWM signal of substantially arbitrary, within wide limitations, frequency and duty cycle at an output terminal such as PWM output 702. Such a microprocessor may also contain timers that may be programmed to turn the PWM output on and off at substantially arbitrary times under CPU control and thereby generate a CPWM signal. In some cases, a microprocessor may have the capability to generate two PWM signals and to have one of these PWM signals turn on and off the output of the other, thereby modulating it. Such an arrangement may require little or no CPU involvement. At the other extreme a microprocessor without an internal PWM generator but with a digital output and a timing capability may be programmed to output a CPWM signal by way of suitably timed commands from the CPU to transition the output between ones and zeros.

Microprocessor 701 configured and programmed as described above with reference to FIG. 15 may be considered to be a rectangular pulse generator system capable of generating a CPWM signal at its output 702.

Figure 16:
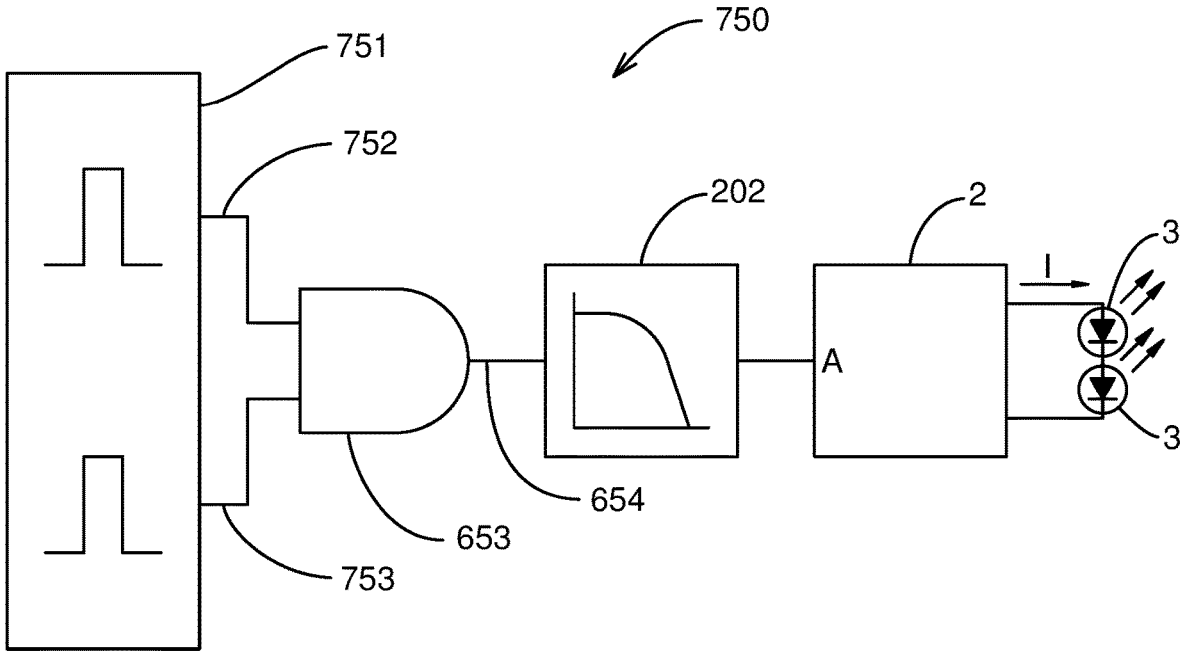
FIG. 16 is a schematic block diagram of an example of a fourth implementation of a CPWM hybrid light flux setting system featuring the use of a microprocessor with two PWM outputs to feed an AND gate and thereby generate the CPWM signal.

FIG. 16 shows a block diagram of a fourth implementation 750 of a CPWM hybrid light flux setting system. A microprocessor with dual PWM outputs 751, including a first PWM output 752 and a second PWM output 753 may have each of these outputs connected to one of the inputs of AND gate 653. The result at AND gate output 654 may be the same as in second implementation 650 in FIG. 14. Fourth implementation 750 has the advantage that it may be applied to generate CPWM signals with no CPU involvement through use of a microprocessor that can automatically (without CPU involvement) generate two PWM outputs though it cannot provide internally for automatic modulation of one of those outputs by another.

The combination of the microprocessor with dual PWM outputs 751 and AND gate 653 connected to each other as shown in FIG. 14, may be considered to be a rectangular pulse generator system capable of generating a CPWM signal at its output 654.

FIGS. 9, 14, 15, and 16 show examples of CPWM generators usable for controlling a hybrid light flux setting system 200, but it will be clear to persons skilled in the art that there also exist other types of electronic circuitry and waveform generators not shown that are capable of generating the described CPWM signals.

Figure 17:
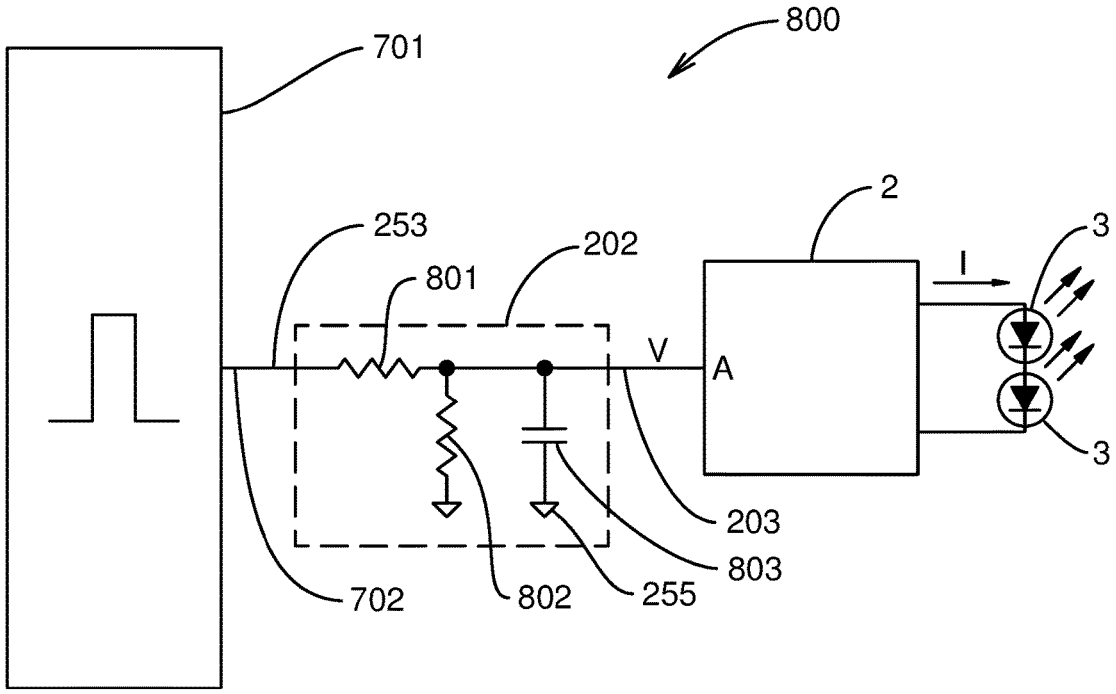
FIG. 17 is a schematic block diagram of an example of a preferred embodiment of a CPWM hybrid light flux setting system using a microprocessor to generate the CPWM signal and including a voltage division capability in the low-pass filter.

A preferred embodiment of a CPWM hybrid light flux setting system may be described as follows. With reference to FIG. 17, a preferred embodiment 800 may include a voltage-controlled current source 2 having a current output I linearly controllable with a control voltage V ranging from of 0.2 to 1.5 volts at analog control input A, which driver may be connected to drive the at least one LED 3. Analog control input A may have an input impedance exceeding 1 megohm. Voltage-controlled current source 2 may have a response time, defined as the time required for LED current I to settle to within one percent of a new current output setting in response to a change in control voltage V, of less than 100 microseconds.

Preferred embodiment 800 may also include a low-pass filter 202 comprising an input resistor 801 with resistance 11,000 ohms, a divider resistor 802 with resistance 11,000 ohms, and an output shunt capacitor 803 with capacitance 6800 pF. Input resistor 801 may be electrically connected at one of its two ends to filter input node 253 and at its other end to filter output node 203. Divider resistor 802 may be electrically connected at one of its two ends to filter output node 203 and at its other end to electrical ground node 255. Output shunt capacitor 803 may be electrically connected at one of its two ends to filter output node 203 and at its other end to electrical ground node 255. Filter output node 203 may be connected to analog control input A.

Further included in preferred embodiment 800 may be microprocessor 701 operating at a clock speed of, for example, 16 MHz and having an automatic PWM generator outputting a PWM waveform at PWM output 702 with a frequency fbase equal to 200 kHz and an arbitrary duty cycle Dbase. PWM output 702 may be connected to filter input node 253. Microprocessor 701 may be powered by a power supply (not shown) regulated at 3.3 volts. Microprocessor 701 may have a CMOS (complementary metal-oxide-semiconductor) output stage at PWM output 702 with output resistance less than 100 ohms both for sourcing of current and for sinking of current. The peak voltage of the signal at PWM output 702 may be substantially equal to 3.3 volts, and the minimum voltage of the signal at PWM output 702 may be substantially equal to 0.0 volts.

Microprocessor 701 may be programmed to modulate PWM output 702 by turning the PWM signal on and off at an arbitrary modulation frequency fmod and an arbitrary duty cycle Dmod. When the PWM signal is off, PWM output 702 may be at zero volts. The resultant signal at PWM output 702 may thus be a CPWM signal with peak amplitude 3.3 volts.

Low-pass filter 202 may act both as a two-to-one voltage divider and as an R-C filter with an R·C time constant of 37.4 microseconds. The voltage at filter output node 203 may range from zero volts to 1.65 volts, depending on the duty cycle Dbase of the automatic PWM generator the modulated signal from which is presented at PWM output 702.

Figure 18:
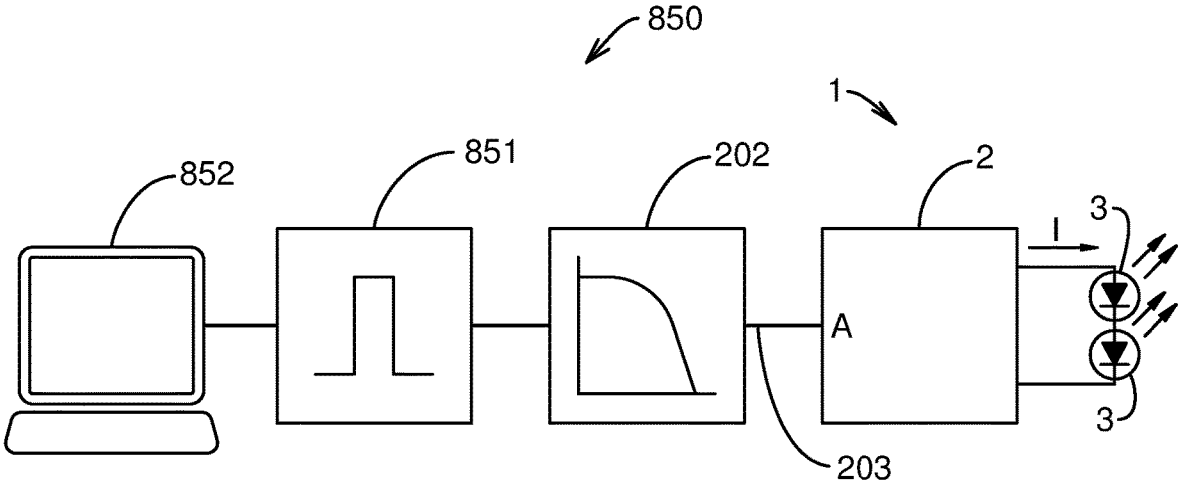
FIG. 18 is a schematic block diagram of an example of a general implementation of a CPWM hybrid light flux setting system with the addition of a user input device.

A more general implementation 850 of a CPWM hybrid light flux setting system is shown as an example in FIG. 18. It may include a rectangular pulse generator system 851 operatively configured to generate a CPWM output signal, a low-pass filter 202 coupled to the rectangular pulse generator system 851 and configured to receive a filter input signal representative of the generator output signal, and an analog-controlled light source 1. Analog-controlled light source 1 may comprise a voltage-controlled current source 2, having an analog control input A, and one or more LEDs 3 the LED current I through which is provided as a drive signal by the voltage-controlled current source 2. The voltage-controlled current source 2 may be coupled through its analog control input A to the filter output node 203 of low-pass filter 202.

A user input device 852 may be coupled to rectangular pulse generator system 851 to allow user or sensor input to select values of control variables that may include modulation frequency fmod, modulation duty cycle Dmod, and the duty cycle Dbase and frequency fbase of the PWM signal being modulated. The user input device 852 may be a computer, a smartphone, a terminal, or any other type of device capable of responding to stimuli—such as user inputs, sensor signals, or automated commands—and controlling rectangular pulse generator system 851. The coupling between the user input device 852 and the rectangular pulse generator system 851 may be wireless or hard-wired.

Figure 19:
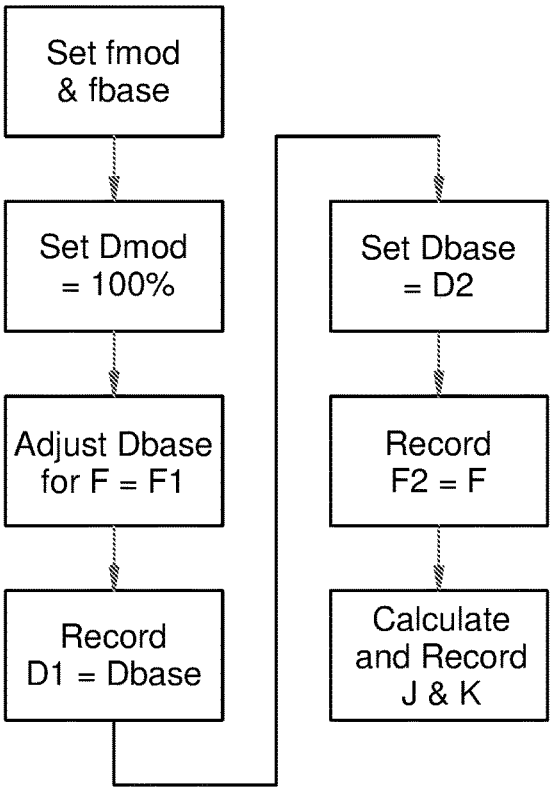
FIG. 19 is a flow chart of an example of a method for calibrating a CPWM hybrid light flux setting system.

The LED light flux characteristics of a CPWM hybrid light flux setting system may be calibrated, providing a light sensor is available that has a known response to the LED light flux. A flow chart for an example of a calibration procedure is shown in FIG. 19.

For example, the LED light flux characteristics of preferred embodiment 800 may be calibrated as follows. The frequency fbase of the PWM signal being modulated may be set to 200 kHz, and modulation frequency fmod may be set to 200 hertz. Modulation duty cycle Dmod may be set to 100%. Duty cycle Dbase may then be adjusted to achieve an LED light flux F, measured by the light sensor, equal to a maximum guaranteed LED light flux of value F1 for the system. The value of duty cycle Dbase resulting from this adjustment may be recorded as D1. Duty cycle Dbase may then be set to a value of D2=20%, and the consequent LED light flux value F2, measured by the light sensor, may be recorded. Two constants G and H may then be calculated as $G=(F1/D1-F2/D2)/(D1-D2)$ and $H=(F2\cdot D1/D2-F1\cdot D2/D1)/(D1-D2)$. The values of two constants $J=H/(2\cdot G)$ and $K=G/H^2$ may then be calculated and stored along with LED light flux value F2 in microprocessor 701's nonvolatile memory. These stored values of constants J and K and LED light flux F2 may constitute the calibration constants of the system.

Figure 20:
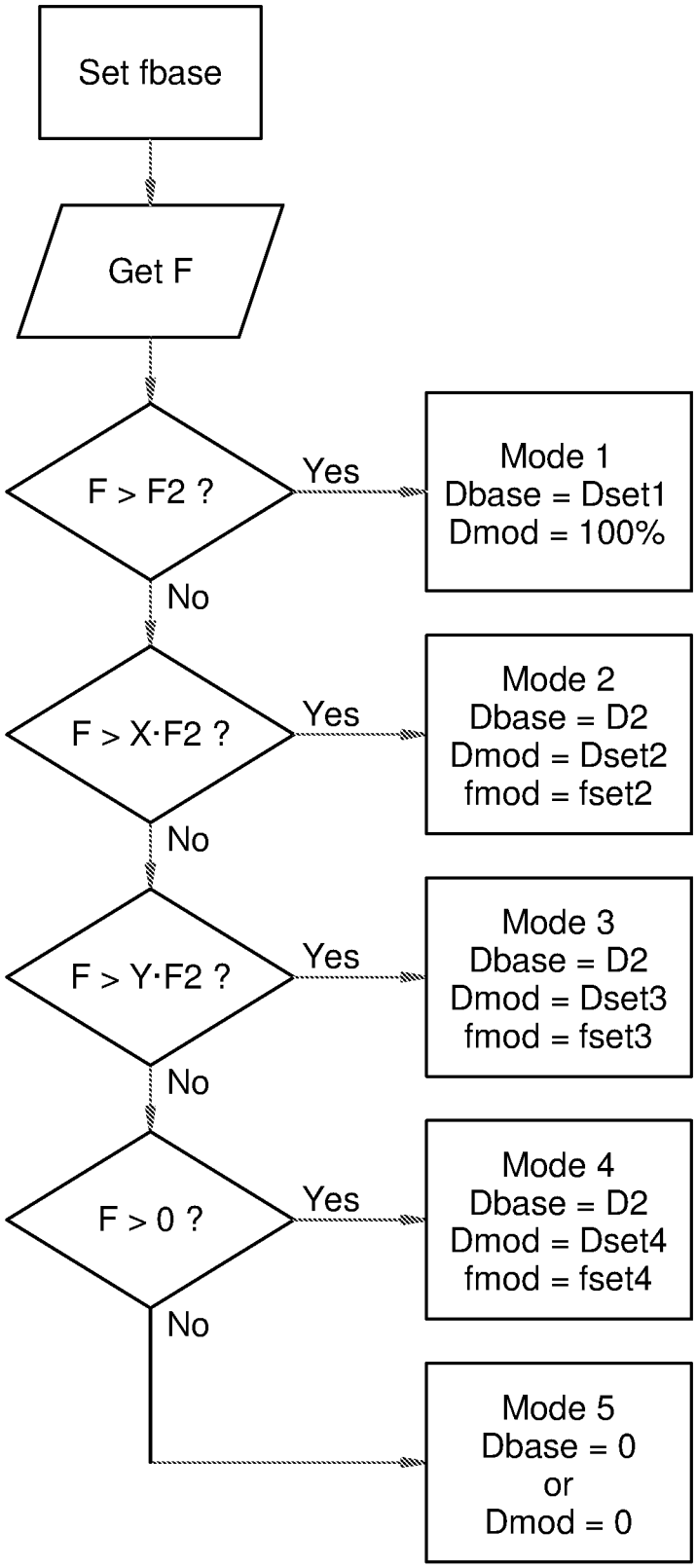
FIG. 20 is a flow chart of an example of a method for setting various average light flux outputs with a CPWM hybrid light flux setting system.

In operation, various LED light flux settings may be achieved as detailed, for example, in the following paragraphs. FIG. 20 shows a flow chart applicable to this example.

For any LED light flux value F greater than F2, the modulation duty cycle Dmod may be set to 100%, and the duty cycle Dbase may be set to the lesser of 1 or $Dset1=J\cdot((1+4\cdot K\cdot F)^{0.5}-1)$. This case may be termed control mode 1.

For any LED light flux value F ranging from LED light flux F2 down to LED light flux X·F2, where in this example X=0.9, the duty cycle Dbase may be frozen at D2=20%, the modulation duty cycle Dmod may be set to the value Dset2=F/F2, and the modulation frequency fmod may be set to fset2=(1−Dset2)/T, where T in this example is 500 microseconds. This case may be termed control mode 2.

For any LED light flux value F ranging from light flux X·F2 down to light flux Y·F2, where in this example Y=0.1, the duty cycle Dbase may remain frozen at D2=20%, the modulation frequency fmod may be set to a value fset3, which in this example equals 200 Hz, and the modulation duty cycle Dmod may be set to the value Dset3=F/F2. This case may be termed control mode 3.

For any LED light flux value F ranging from light flux Y·F2 down to arbitrarily low average light flux values, duty cycle Dbase may remain at D2=20%, the modulation duty cycle Dmod may be set to the value Dset4=F/F2, and the modulation frequency fmod may be set to fset4=Dset4/T, where T in this example is 500 microseconds. This case may be termed control mode 4.

Finally, for an LED light flux value F that is not greater than zero, it is sufficient to either set the modulation duty cycle Dmod to zero and/or to set the duty cycle Dbase of the automatic PWM generator to zero. This case may be termed control mode 5.

Altogether, in this scheme there are five control modes. The rationale behind this five-mode approach is as follows.

Control mode 1 uses an analog control method to dim the LEDs. Advantage is taken of the fact that the efficiency, defined as the light flux per unit of electrical power consumed, of the at least one LED 3 and the voltage-controlled current source 2 taken together rises as the LED current I through the at least one LED 3 drops from its highest level down to about 20% of the highest level. In this first control mode the control variable is the duty cycle Dbase of the PWM generator in microprocessor 701, and the light flux as a function of this control variable fits substantially accurately a quadratic relationship that can be inverted to calculate the control variable value required to produce a desired light flux. The other four control modes keep the operating current of the LEDs at the high-efficiency 20% level. The 20% level may be sufficiently above the low end of the range of operating currents prescribed by the LED manufacturer for reliable and consistent operation of the LEDs.

At the maximum guaranteed LED light flux of value F1 the calibrated value of Dset1 may be less than 100%, since the at least one LED 3 may be more efficient in some instances than in others. The method of control mode 1 may accommodate settings of LED light flux F greater than F1 producing accurate responses so long as the calculated value of Dset1 remains no higher than 100%. If the user-derived setting of LED light flux F is so high that the calculated value of Dset1 would exceed 100%, Dset1 is limited to exactly 100%, which may produce the maximum LED light flux F of which the system is capable.

Control mode 2 pulse-code modulates the 20%-of-maximum current, periodically turning it off for a time period T=500 microseconds. This off-time period is long enough to allow both the driver and the low-pass filter output to settle sufficiently to prevent significant response-time-related errors in the average light flux. The modulation frequency fmod in this control mode varies from arbitrarily low values up to a maximum of 200 hertz. Flicker, which can be annoying to humans, begins to become discernible when light flux is turned on and off at a modulation frequency fmod below 200 hertz. However, when the off time is only 500 microseconds and the average dimming caused by the modulation is no more than 10%, the flicker may be imperceptible. In the example of the preferred embodiment, the average dimming at a modulation frequency fmod of 100 hertz will be 5% and at 50 hertz will be only 2.5%. Flicker should be insignificant.

In control mode 3 the modulation frequency fmod remains constant at 200 hertz while the modulation duty cycle changes. Flicker is avoided by virtue of the 200 hertz modulation frequency. The low end of the average light flux range in this control mode occurs when the modulation pulse width falls to 500 microseconds, below which response times might affect the accuracy of the average light flux settings.

In control mode 4 the modulation duty cycle depends on modulation frequency fmod, which drops below 200 hertz to continue the reduction in average light flux while maintaining the modulation pulse width at 500 microseconds. A shortcoming of this control mode is that flicker becomes pronounced as the light flux is further reduced. In some applications, however, such as the provision of light for photosynthesis of plants, the flicker may be inconsequential.

In control mode 5 the intention is to turn the at least one LED 3 off completely so that the LED light flux is zero. The intention is accomplished if the duty cycle of either the base PWM generator or the modulator is set to zero so that no pulses are generated.

Overall, the five-mode hybrid analog/PWM LED light flux setting scheme with the settings and component values described offers accurate average light flux settings over a 50-to-1 flicker-free dimming range and over a substantially infinite dimming range when perceptible flicker is allowed. The code for calculating and setting the modulation frequency fmod, the modulation duty cycle Dmod, and the microprocessor's automatic PWM duty cycle Dbase to achieve a user-specified light flux F may be programmed into the microprocessor 701, rendering the manipulations invisible to the user and seemingly instantaneous.

The LED light flux setting system described takes advantage of the improved efficiency that analog control may provide at moderate dimming levels and also retains the advantages of high linearity and extended dimming range that PWM may provide. It provides for calibration of the LED light flux so that the flux at any dimming level may be constant from one light source to another despite unit-to-unit variations in light source performance. It also allows the user to set the LED light flux to values above the maximum guaranteed LED light flux value F1 to achieve LED light fluxes up to the maximum level of which the system is capable. Additionally, the LED light flux setting system described minimizes flicker in the light source, so that flicker is negligible over a wider range of average LED light flux values than can be covered with pure PWM control.

It will be understood by persons skilled in the art that many variations in the operational aspects of this LED light flux setting scheme may be contemplated. The cross-over points between control phases may be changed, maximum frequencies and response time allowances may change, the low-pass filter design and order may be changed, the criteria to be met for flicker-free lighting may be changed, the CPWM generation scheme may be changed, the calibration or curve-fitting method may be altered, and/or there may be other changes not mentioned. Depending on accuracy, flicker, and dimming range requirements or latitudes, one or more of the control phases may be eliminated completely or additional control phases may be added.

CPWM hybrid light flux setting systems described herein may be applied not just to LED lighting control, but also, with modifications, to motor control, power control, or the control of other items. CPWM hybrid light flux setting systems may be particularly advantageous in applications in which the item being controlled operates more efficiently at low analog control levels than at high control levels.

Adjustments may be added to the LED light flux setting system to compensate for variables such as operating temperature and age. For instance, a microprocessor that generates and/or controls the CPWM signal for setting the LED light flux may include a temperature sensor, and the microprocessor may make use of the measured temperature and the flux-versus-temperature characteristics of the LEDs to appropriately adjust the target light flux level F to be achieved by the LED light flux setting system and to thereby correct for temperature variations.

Accordingly, while embodiments have been particularly shown and described, many variations may be made therein. Other combinations of features, functions, elements, and/or properties may be used. Such variations, whether they are directed to different combinations or directed to the same combinations, whether different, broader, narrower, or equal in scope, are also included.

The remainder of this section describes additional aspects and features of a compound-PWM hybrid LED light flux setting system presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference, in any suitable manner. Some of the paragraphs below expressly refer to and further limit other paragraphs, providing without limitation examples of some of the suitable combinations.

A1. An LED light flux setting system comprising:

a rectangular pulse generator system operatively configured to generate a generator output signal, the generator output signal formed as a base rectangular waveform gated by a modulating rectangular waveform, the base rectangular waveform having a first frequency and the modulating rectangular waveform having a second frequency less than the first frequency;

a low-pass filter having a cutoff frequency, the low-pass filter coupled to the rectangular pulse generator system and configured to receive a filter input signal representative of the generator output signal and being configured to produce a filter output signal representative of the filter input signal with frequencies above the cut-off frequency being attenuated compared to frequencies below the cutoff frequency;

a voltage-controlled current source coupled to the low-pass filter and responsive to a control voltage signal representative of the filter output signal for generating an LED drive signal having a current level representative of a voltage level of the control voltage signal; and at least one LED configured to conduct the LED drive signal, the at least one LED producing a light flux determined by the current level of the LED drive signal.

A2. The LED light flux setting system of paragraph A1, wherein the rectangular pulse generator system is controllable to vary the second frequency of the modulating rectangular waveform.

A3. The LED light flux setting system of paragraph A1, wherein the modulating rectangular waveform has pulses with a second duty cycle, and the rectangular pulse generator system is controllable to vary the second duty cycle.

A4. The LED light flux setting system of paragraph A1, wherein the rectangular pulse generator system is controllable to vary the first frequency of the base rectangular waveform.

A5. The LED light flux setting system of paragraph A1, wherein the base rectangular waveform has pulses with a first duty cycle, and the rectangular pulse generator system is controllable to vary the first duty cycle.

A6. The LED light flux setting system of paragraph A1, wherein the low-pass filter has a cut-off frequency below the first frequency.

A7. The LED light flux setting system of paragraph A1, wherein the low-pass filter has a cut-off frequency above the second frequency.

A8. The LED light flux setting system of paragraph A6, wherein the rectangular pulse generator system includes a base rectangular pulse generator for generating the base rectangular waveform, the base rectangular pulse generator being responsive to the modulating rectangular waveform for gating the base rectangular waveform.

A9. The LED light flux setting system of paragraph A8, wherein the rectangular pulse generator system further includes a modulating rectangular pulse generator for generating the modulating rectangular waveform.

A10. The LED light flux setting system of paragraph A1, wherein the rectangular pulse generator system includes an AND gate, a base rectangular pulse generator coupled to a first input of the AND gate, and a modulating rectangular pulse generator coupled to a second input of the AND gate, the base rectangular pulse generator is configured to generate the base rectangular waveform, the modulating rectangular pulse generator is configured to generate the modulating rectangular waveform, and the AND gate is responsive to the base rectangular waveform and the modulating rectangular waveform for producing the generator output signal.

A11. The LED light flux setting system of paragraph A1, wherein the rectangular pulse generator system includes a microprocessor configured to generate the generator output signal.

A12. The LED light flux setting system of paragraph A1, wherein the rectangular pulse generator system includes a microprocessor configured to generate at least one of the base rectangular waveform and the modulating rectangular waveform.

A13. The LED light flux setting system of paragraph A12, wherein the microprocessor is configured to generate both the base rectangular waveform and the modulating rectangular waveform, and the rectangular pulse generator system further includes an AND gate responsive to the base rectangular waveform and the modulating rectangular waveform for producing the generator output signal.

A14. An LED light flux setting system comprising:

a microprocessor configured to generate a generator output signal, the generator output signal formed as a base rectangular waveform gated by a modulating rectangular waveform, the base rectangular waveform having a first frequency more than 10 kHz and the modulating rectangular waveform having a second frequency less than one-tenth of the first frequency, the microprocessor being controllable to vary a duty cycle of the base rectangular waveform and a frequency and duty cycle of the modulating rectangular waveform;

a low-pass filter having a cut-off frequency between the first frequency and the second frequency, the low-pass filter coupled to the rectangular pulse generator system and configured to receive a filter input signal representative of the generator output signal and produce a filter output signal representative of the filter input signal with frequencies above the cut-off frequency being attenuated compared to frequencies below the cutoff frequency, the low-pass filter including a capacitor and a resistive voltage divider, the resistive voltage divider applying a portion of a voltage of the filter input signal to the capacitor;

a voltage-controlled current source coupled to the low-pass filter and responsive to a control voltage signal representative of the filter output signal for generating an LED drive signal having a current level representative of a voltage level of the control voltage signal; and at least one LED configured to conduct the LED drive signal, the at least one LED producing a light flux determined by the current level of the LED drive signal.

A15. The LED light flux setting system of paragraph A14, wherein the microprocessor is configured to operate in a first mode in which the duty cycle of the base rectangular waveform is controllable and the duty cycle and frequency of the modulating rectangular waveform are constant, and at least a second mode in which the duty cycle of the base rectangular waveform and frequency of the modulating rectangular waveform are held constant and the duty cycle of the modulating rectangular waveform is controllable.

A16. The LED light flux setting system of paragraph A15, wherein the at least a second mode includes a third mode, and the frequency of the modulating rectangular waveform is different in the second mode and the third mode.

B1. An LED light flux setting method comprising:

generating, by a rectangular pulse generator system, a base rectangular waveform having a first frequency and a first duty cycle;

gating the base rectangular waveform with a modulating rectangular waveform having a second frequency less than the first frequency and a second duty cycle, the gated base rectangular waveform forming a generator output signal;

filtering a filter input signal representative of the generator output signal with a low-pass filter having a cutoff frequency to produce a filter output signal representative of the filter input signal with frequencies above the cut-off frequency being attenuated compared to frequencies below the cutoff frequency;

generating an LED drive signal having a current level representative of a voltage level of a control voltage signal representative of the filter output signal; and producing a light flux determined by the current level of the LED drive signal by conducting the LED drive signal in at least one LED.

B2. The LED light flux setting method of paragraph B1, further comprising:

receiving by the rectangular pulse generator one or more inputs representative of intended values of the first duty cycle, the second duty cycle, and the second frequency; and setting the values of the first duty cycle, the second duty cycle, and the second frequency in response to the received one or more inputs.

B3. The LED light flux setting method of paragraph B2, further comprising:

provision by a processor to the rectangular pulse generator of an input representative of an intended second-duty-cycle value of 100%;

operation by the processor to find and store in memory, for each of one or more predetermined time-averaged-light-flux-calibration values, a value of the first duty cycle that, when set, causes the time-averaged light flux measure provided by a sensor to have approximately the time-averaged-light-flux-calibration value;

operation by the processor to, for each of one or more predetermined first-duty-cycle-calibration values, provide an input to the rectangular pulse generator to cause the value of the first duty cycle to be set to the first-duty-cycle-calibration value and to, once the first duty cycle is set, store the resulting time-averaged light flux measure provided by the sensor; and operation by the processor to calculate and store in memory, using the one or more predetermined time-averaged-light-flux-calibration values, the one or more stored values of the first duty cycle, the one or more predetermined first-duty-cycle-calibration values, and the one or more stored time-averaged light flux measures, one or more fitting constants that the processor can subsequently use, possibly along with one or more predetermined constants, to determine an approximate setting of the first duty cycle that will result in a prescribed obtainable numerical measure from the sensor of the time-averaged light flux produced by the at least one LED.

B4. The LED light flux setting method of paragraph B3, wherein the number of values of fitting constants stored by the processor is two and wherein the approximate setting of the first duty cycle is determined from the inverse of a quadratic relationship, which quadratic relationship relates the numerical measure provided by the sensor to the value of the first duty cycle and gives a numerical measure of zero when the first duty cycle is zero.

B5. The LED light flux setting method of paragraph B2, further comprising:

receiving by a processor an input representative of an intended value of time-averaged light flux;

calculation by the processor, using stored values of fitting constants, of a calculated first-duty-cycle value that, when set as the value of the first duty cycle while the second duty cycle is 100%, should result in production of a time-averaged light flux by the at least one LED approximately equal to the intended value of time-averaged light flux;

calculation by the processor of a limited first-duty-cycle value equal to 100% if the calculated first-duty-cycle value is greater than 100%, equal to a predetermined minimum value less than 100% if the calculated first-duty-cycle value is less than the predetermined minimum value, or equal to the calculated first-duty-cycle value if the calculated first-duty-cycle value not greater than 100% and not less than the predetermined minimum value;

provision by the processor to the rectangular pulse generator of an input representative of an intended first-duty-cycle value the same as the limited first-duty-cycle value; and, if the calculated first-duty-cycle value is not less than the prescribed minimum value, provision by the processor to the rectangular pulse generator of an input representative of an intended second-duty-cycle value of 100%.

B6. The LED light flux setting method of paragraph B5, further comprising:

calculation by the processor, either from one or more stored values of time-averaged light flux measure or using the stored values of the fitting constants, the time-averaged light flux value F2 expected when the first duty cycle is set to the predetermined minimum value and the second duty cycle is set to 100%;

determination by the processor of a Boolean result, the Boolean result being true if the intended value of time-averaged light flux is less than time-averaged light flux value F2 and no less than a predetermined fraction X of time-averaged light flux value F2, and the Boolean result being false otherwise;

performance of the following operations if, and only if, the Boolean result is true;

calculation by the processor of a calculated second-duty-cycle value equal to the intended value of time-averaged light flux divided by time-averaged light flux value F2;

calculation by the processor of a calculated second-frequency value obtained by dividing a predetermined minimum time-period value into the difference between 100% and the calculated second-duty-cycle value; and provision by the processor to the rectangular pulse generator of an input representative of an intended second-duty-cycle value the same as the calculated second-duty-cycle value and an input representative of an intended second-frequency value the same as the calculated second-frequency value.

B7. The LED light flux setting method of paragraph B5, further comprising:

calculation by the processor, either from one or more stored values of time-averaged light flux measure or using the stored values of the fitting constants, the time-averaged light flux value F2 expected when the first duty cycle is set to the predetermined minimum value and the second duty cycle is set to 100%;

determination by the processor of a Boolean result, the Boolean result being true if the intended value of time-averaged light flux is less than a predetermined fraction X of time-averaged light flux value F2 and no less than a predetermined fraction Y of time-averaged light flux value F2, and the Boolean result being false otherwise;

performance of the following operations if, and only if, the Boolean result is true;

calculation by the processor of a calculated second-duty-cycle value equal to the intended value of time-averaged light flux divided by time-averaged light flux value F2; and provision by the processor to the rectangular pulse generator of an input representative of an intended second-duty-cycle value the same as the calculated second-duty-cycle value and an input representative of an intended second-frequency value the same as a predetermined reference second-frequency value.

B8. The LED light flux setting method of paragraph B5, further comprising:

calculation by the processor, either from one or more stored values of time-averaged light flux measure or using the stored values of the fitting constants, the time-averaged light flux value F2 expected when the first duty cycle is set to the predetermined minimum value and the second duty cycle is set to 100%;

determination by the processor of a Boolean result, the Boolean result being true if the intended value of time-averaged light flux is greater than zero and less than a predetermined fraction Y of time-averaged light flux value F2, and the Boolean result being false otherwise;

performance of the following operations if, and only if, the Boolean result is true;

calculation by the processor of a calculated second-duty-cycle value equal to the intended value of time-averaged light flux divided by time-averaged light flux value F2;

calculation by the processor of a calculated second-frequency value equal to the calculated second-duty-cycle value divided by a predetermined minimum time-period value;

provision by the processor to the rectangular pulse generator of an input representative of an intended second-duty-cycle value the same as the calculated second-duty-cycle value and an input representative of an intended second-frequency value the same as the calculated second-frequency value.

B9. The LED light flux setting method of paragraph B5, further comprising:

determination by the processor of a Boolean result, the Boolean result being true if the intended value of time-averaged light flux is less than or equal to zero, and the Boolean result being false otherwise;

performance of the following operation if, and only if, the Boolean result is true;

provision by the processor to the rectangular pulse generator of an input representative of an intended first-duty-cycle value of zero or an input representative of an intended second-duty-cycle value of zero.

INDUSTRIAL APPLICABILITY

The methods and apparatus described in the present disclosure are applicable to the general lighting industry, the decorative lighting industry, the specialty lighting industry, the agricultural lighting industry, the horticultural lighting industry, the research lighting industry, the military lighting industry, and all other industries in which LEDs or other electrically-powered sources are employed to produce light. They are also applicable to other industries in which items are to be controlled electrically and can benefit from an accurate implementation of analog control combined with pulse-code modulation control.

What is claimed is:

1. An LED light flux setting system comprising:

a rectangular pulse generator system operatively configured to generate a generator output signal, the generator output signal formed as a base rectangular waveform gated by a modulating rectangular waveform, the base rectangular waveform having a first frequency and the modulating rectangular waveform having a second frequency less than the first frequency;

a low-pass filter having a cutoff frequency, the low-pass filter coupled to the rectangular pulse generator system and configured to receive a filter input signal representative of the generator output signal and being configured to produce a filter output signal representative of the filter input signal with frequencies above the cut-off frequency being attenuated compared to frequencies below the cutoff frequency;

a voltage-controlled current source coupled to the low-pass filter and responsive to a control voltage signal representative of the filter output signal for generating an LED drive signal having a current level representative of a voltage level of the control voltage signal; and at least one LED configured to conduct the LED drive signal, the at least one LED producing a light flux determined by the current level of the LED drive signal.

2. The LED light flux setting system of claim 1, wherein the rectangular pulse generator system is controllable to vary the second frequency of the modulating rectangular waveform.

3. The LED light flux setting system of claim 1, wherein the modulating rectangular waveform has pulses with a second duty cycle, and the rectangular pulse generator system is controllable to vary the second duty cycle.

4. The LED light flux setting system of claim 1, wherein the rectangular pulse generator system is controllable to vary the first frequency of the base rectangular waveform.

5. The LED light flux setting system of claim 1, wherein the base rectangular waveform has pulses with a first duty cycle, and the rectangular pulse generator system is controllable to vary the first duty cycle.

6. The LED light flux setting system of claim 1, wherein the low-pass filter has a cut-off frequency below the first frequency.

7. The LED light flux setting system of claim 1, wherein the low-pass filter has a cut-off frequency above the second frequency.

8. The LED light flux setting system of claim 6, wherein the rectangular pulse generator system includes a base rectangular pulse generator for generating the base rectangular waveform, the base rectangular pulse generator being responsive to the modulating rectangular waveform for gating the base rectangular waveform.

9. The LED light flux setting system of claim 8, wherein the rectangular pulse generator system further includes a modulating rectangular pulse generator for generating the modulating rectangular waveform.

10. The LED light flux setting system of claim 1, wherein the rectangular pulse generator system includes an AND gate, a base rectangular pulse generator coupled to a first input of the AND gate, and a modulating rectangular pulse generator coupled to a second input of the AND gate, the base rectangular pulse generator is configured to generate the base rectangular waveform, the modulating rectangular pulse generator is configured to generate the modulating rectangular waveform, and the AND gate is responsive to the base rectangular waveform and the modulating rectangular waveform for producing the generator output signal.

11. The LED light flux setting system of claim 1, wherein the rectangular pulse generator system includes a microprocessor configured to generate the generator output signal.

12. The LED light flux setting system of claim 1, wherein the rectangular pulse generator system includes a microprocessor configured to generate at least one of the base rectangular waveform and the modulating rectangular waveform.

13. The LED light flux setting system of claim 12, wherein the microprocessor is configured to generate both the base rectangular waveform and the modulating rectangular waveform, and the rectangular pulse generator system further includes an AND gate responsive to the base rectangular waveform and the modulating rectangular waveform for producing the generator output signal.

14. An LED light flux setting system comprising:

a microprocessor configured to generate a generator output signal, the generator output signal formed as a base rectangular waveform gated by a modulating rectangular waveform, the base rectangular waveform having a first frequency more than 10 kHz and the modulating rectangular waveform having a second frequency less than one-tenth of the first frequency, the microprocessor being controllable to vary a duty cycle of the base rectangular waveform and a frequency and duty cycle of the modulating rectangular waveform;

a low-pass filter having a cut-off frequency between the first frequency and the second frequency, the low-pass filter coupled to the rectangular pulse generator system and configured to receive a filter input signal representative of the generator output signal and produce a filter output signal representative of the filter input signal with frequencies above the cut-off frequency being attenuated compared to frequencies below the cutoff frequency, the low-pass filter including a capacitor and a resistive voltage divider, the resistive voltage divider applying a portion of a voltage of the filter input signal to the capacitor;

a voltage-controlled current source coupled to the low-pass filter and responsive to a control voltage signal representative of the filter output signal for generating an LED drive signal having a current level representative of a voltage level of the control voltage signal; and at least one LED configured to conduct the LED drive signal, the at least one LED producing a light flux determined by the current level of the LED drive signal.

15. The LED light flux setting system of claim 14, wherein the microprocessor is configured to operate in a first mode in which the duty cycle of the base rectangular waveform is controllable and the duty cycle and frequency of the modulating rectangular waveform are constant, and at least a second mode in which the duty cycle of the base rectangular waveform and frequency of the modulating rectangular waveform are held constant and the duty cycle of the modulating rectangular waveform is controllable.

16. The LED light flux setting system of claim 15, wherein the at least a second mode includes a third mode, and the frequency of the modulating rectangular waveform is different in the second mode and the third mode.

17. An LED light flux setting method comprising:

generating, by a rectangular pulse generator system, a base rectangular waveform having a first frequency and a first duty cycle;

gating the base rectangular waveform with a modulating rectangular waveform having a second frequency less than the first frequency and a second duty cycle, the gated base rectangular waveform forming a generator output signal;

filtering a filter input signal representative of the generator output signal with a low-pass filter having a cutoff frequency to produce a filter output signal representative of the filter input signal with frequencies above the cut-off frequency being attenuated compared to frequencies below the cutoff frequency;

generating an LED drive signal having a current level representative of a voltage level of a control voltage signal representative of the filter output signal; and producing a light flux determined by the current level of the LED drive signal by conducting the LED drive signal in at least one LED.

18. The LED light flux setting method of claim 17, further comprising:

receiving by the rectangular pulse generator one or more inputs representative of intended values of the first duty cycle, the second duty cycle, and the second frequency; and setting the values of the first duty cycle, the second duty cycle, and the second frequency in response to the received one or more inputs.

19. The LED light flux setting method of claim 18, further comprising:

provision by a processor to the rectangular pulse generator of an input representative of an intended second-duty-cycle value of 100%;

operation by the processor to find and store in memory, for each of one or more predetermined time-averaged-light-flux-calibration values, a value of the first duty cycle that, when set, causes the time-averaged light flux measure provided by a sensor to have approximately the time-averaged-light-flux-calibration value;

operation by the processor to, for each of one or more predetermined first-duty-cycle-calibration values, provide an input to the rectangular pulse generator to cause the value of the first duty cycle to be set to the first-duty-cycle-calibration value and to, once the first duty cycle is set, store the resulting time-averaged light flux measure provided by the sensor; and operation by the processor to calculate and store in memory, using the one or more predetermined time-averaged-light-flux-calibration values, the one or more stored values of the first duty cycle, the one or more predetermined first-duty-cycle-calibration values, and the one or more stored time-averaged light flux measures, one or more fitting constants that the processor can subsequently use, possibly along with one or more predetermined constants, to determine an approximate setting of the first duty cycle that will result in a prescribed obtainable numerical measure from the sensor of the time-averaged light flux produced by the at least one LED.

20. The LED light flux setting method of claim 19, wherein the number of values of fitting constants stored by the processor is two and wherein the approximate setting of the first duty cycle is determined from the inverse of a quadratic relationship, which quadratic relationship relates the numerical measure provided by the sensor to the value of the first duty cycle and gives a numerical measure of zero when the first duty cycle is zero.

21. The LED light flux setting method of claim 18, further comprising:

receiving by a processor an input representative of an intended value of time-averaged light flux;

calculation by the processor, using stored values of fitting constants, of a calculated first-duty-cycle value that, when set as the value of the first duty cycle while the second duty cycle is 100%, should result in production of a time-averaged light flux by the at least one LED approximately equal to the intended value of time-averaged light flux;

calculation by the processor of a limited first-duty-cycle value equal to 100% if the calculated first-duty-cycle value is greater than 100%, equal to a predetermined minimum value less than 100% if the calculated first-duty-cycle value is less than the predetermined minimum value, or equal to the calculated first-duty-cycle value if the calculated first-duty-cycle value is not greater than 100% and not less than the predetermined minimum value;

provision by the processor to the rectangular pulse generator of an input representative of an intended first-duty-cycle value the same as the limited first-duty-cycle value; and, if the calculated first-duty-cycle value is not less than the prescribed minimum value, provision by the processor to the rectangular pulse generator of an input representative of an intended second-duty-cycle value of 100%.

22. The LED light flux setting method of claim 21, further comprising:

calculation by the processor, either from one or more stored values of time-averaged light flux measure or using the stored values of the fitting constants, the time-averaged light flux value F2 expected when the first duty cycle is set to the predetermined minimum value and the second duty cycle is set to 100%.

determination by the processor of a Boolean result, the Boolean result being true if the intended value of time-averaged light flux is less than time-averaged light flux value F2 and no less than a predetermined fraction X of time-averaged light flux value F2, and the Boolean result being false otherwise;

performance of the following operations if, and only if, the Boolean result is true;

calculation by the processor of a calculated second-duty-cycle value equal to the intended value of time-averaged light flux divided by time-averaged light flux value F2;

calculation by the processor of a calculated second-frequency value obtained by dividing a predetermined minimum time-period value into the difference between 100% and the calculated second-duty-cycle value; and provision by the processor to the rectangular pulse generator of an input representative of an intended second-duty-cycle value the same as the calculated second-duty-cycle value and an input representative of an intended second-frequency value the same as the calculated second-frequency value.

23. The LED light flux setting method of claim 21, further comprising:

calculation by the processor, either from one or more stored values of time-averaged light flux measure or using the stored values of the fitting constants, the time-averaged light flux value F2 expected when the first duty cycle is set to the predetermined minimum value and the second duty cycle is set to 100%;

determination by the processor of a Boolean result, the Boolean result being true if the intended value of time-averaged light flux is less than a predetermined fraction X of time-averaged light flux value F2 and no less than a predetermined fraction Y of time-averaged light flux value F2, and the Boolean result being false otherwise;

performance of the following operations if, and only if, the Boolean result is true;

calculation by the processor of a calculated second-duty-cycle value equal to the intended value of time-averaged light flux divided by time-averaged light flux value F2; and provision by the processor to the rectangular pulse generator of an input representative of an intended second-duty-cycle value the same as the calculated second-duty-cycle value and an input representative of an intended second-frequency value the same as a predetermined reference second-frequency value.

24. The LED light flux setting method of claim 21, further comprising:

calculation by the processor, either from one or more stored values of time-averaged light flux measure or using the stored values of the fitting constants, the time-averaged light flux value F2 expected when the first duty cycle is set to the predetermined minimum value and the second duty cycle is set to 100%;

determination by the processor of a Boolean result, the Boolean result being true if the intended value of time-averaged light flux is greater than zero and less than a predetermined fraction Y of time-averaged light flux value F2, and the Boolean result being false otherwise;

performance of the following operations if, and only if, the Boolean result is true;

calculation by the processor of a calculated second-duty-cycle value equal to the intended value of time-averaged light flux divided by time-averaged light flux value F2;

calculation by the processor of a calculated second-frequency value equal to the calculated second-duty-cycle value divided by a predetermined minimum time-period value; and provision by the processor to the rectangular pulse generator of an input representative of an intended second-duty-cycle value the same as the calculated second-duty-cycle value and an input representative of an intended second-frequency value the same as the calculated second-frequency value.

25. The LED light flux setting method of claim 21, further comprising:

determination by the processor of a Boolean result, the Boolean result being true if the intended value of time-averaged light flux is less than or equal to zero, and the Boolean result being false otherwise;

performance of the following operation if, and only if, the Boolean result is true;

provision by the processor to the rectangular pulse generator of an input representative of an intended first-duty-cycle value of zero or an input representative of an intended second-duty-cycle value of zero.

* * * * *